US011603248B1

(12) United States Patent
Parella et al.

(10) Patent No.: US 11,603,248 B1
(45) Date of Patent: Mar. 14, 2023

(54) FOLDABLE CORRUGATED CORNER ELEMENTS

(71) Applicant: RATIONAL PACKAGING LLC, Springfield, TN (US)

(72) Inventors: Shawn M. Parella, Greenbrier, TN (US); Samuel C. Voorhees, Louisville, KY (US)

(73) Assignee: Rational Packaging LLC, Springfield, TN (US)

( * ) Notice: Subject to any disclaimer, the term of this patent is extended or adjusted under 35 U.S.C. 154(b) by 103 days.

(21) Appl. No.: 17/087,588

(22) Filed: Nov. 2, 2020

Related U.S. Application Data

(63) Continuation-in-part of application No. 29/667,161, filed on Oct. 18, 2018, now Pat. No. Des. 908,003, and a continuation-in-part of application No. 15/964,439, filed on Apr. 27, 2018, now Pat. No. 10,822,138, and a continuation-in-part of application No. 29/593,144, filed on Feb. 6, 2017, now Pat. No. Des. 871,213, and a continuation-in-part of application No. 29/593,147, filed on Feb. 6, 2017, now Pat. No. Des. 871,908.

(51) Int. Cl.
*B65D 81/05* (2006.01)

(52) U.S. Cl.
CPC ..... *B65D 81/056* (2013.01); *B65D 2581/053* (2013.01)

(58) Field of Classification Search
CPC ..... B65D 81/053; B65D 81/054; B65D 2581/053; B65D 81/056
USPC ..... 206/586
See application file for complete search history.

(56) References Cited

U.S. PATENT DOCUMENTS 3,684,636 A * 8/1972 Rothrock, Jr. et al. ..... B65D 81/057 428/80
4,125,187 A * 11/1978 Vecchiotti ..... H01M 50/10 220/675
5,385,236 A * 1/1995 Cowan ..... B65D 71/04 206/453
6,007,469 A * 12/1999 Jaegers ..... B65D 81/054 493/356
6,357,587 B1 * 3/2002 Melms, Jr. ..... B65D 85/64 206/326
6,629,608 B2 * 10/2003 Hurley ..... B65D 81/056 206/453
7,048,118 B2 * 5/2006 Baechle ..... B65D 61/00 206/320

(Continued)

*Primary Examiner* — Steven A. Reynolds
(74) *Attorney, Agent, or Firm* — Shaddock Law Group, PC

(57) ABSTRACT

A foldable corrugated corner element including at least some of a portion of material extending from a first terminal end to a second terminal end; a first corner element leg and a second corner element leg, each having one or more alternating ridges and grooves, wherein the second corner element leg extends from the first corner element leg; a notch formed in at least a portion of the first corner element leg, defined by converging sidewalls, wherein the notch allows the second corner element leg to be folded; and one or more apertures formed through a portion of the second corner element leg, wherein if the second corner element leg is folded, the apertures expand and hinges defined between adjacent apertures provide continuity for a portion of the second corner element leg.

19 Claims, 19 Drawing Sheets

(56) References Cited

U.S. PATENT DOCUMENTS

| | | | | |
|---|---|---|---|---|
| 7,137,517 | B2 * | 11/2006 | Lowry | B65D 21/0215 229/199 |
| 8,753,731 | B2 * | 6/2014 | Dunn | B65D 81/056 428/116 |
| 10,822,138 | B1 * | 11/2020 | Voorhees | B65D 81/053 |
| 10,899,524 | B1 * | 1/2021 | Voorhees | B65D 81/054 |
| 2010/0187153 | A1 * | 7/2010 | Simms | B65D 81/054 206/586 |

* cited by examiner

FOLDABLE CORRUGATED CORNER ELEMENTS

CROSS-REFERENCE TO RELATED APPLICATIONS

This patent application is a continuation-in-part of U.S. patent application Ser. No. 15/964,439, filed Apr. 27, 2018, and claims the benefit of U.S. patent application Ser. No. 29/667,161 filed Oct. 18, 2018, the benefit of U.S. patent application Ser. No. 29/593,144 filed Feb. 6, 2017, and the benefit of U.S. patent application Ser. No. 29/593,147, filed Feb. 6, 2017, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of packaging assemblies. More specifically, the present disclosure relates to a corrugated corner element.

2. Description of Related Art

It is generally known to use various packaging assemblies to package products for storage or shipping. Typically, packaging assemblies are constructed so as to stabilize the contained item or items and provide a certain degree of cushioning against breakage, while being moved or transported.

Depending on the size, shape, and/or weight of the contained item or items, packaging assemblies may be placed atop one another or pallets for storage, shipping, or transportation.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, typical packaging assemblies and assembly components have various shortcomings. Among other things, known packaging assemblies and/or assembly components are cumbersome and have shapes that are not conducive to being packaged for shipment prior to assembly. Thus, shipping certain of the assembly components can be inefficient.

Additionally, the present disclosure provides an elongate packaging element that can not only optionally be bent or folded along a longitudinal axis (along the long axis of the packaging assembly, parallel to a series of alternating ridges and grooves), but can also be bent or folded along a transverse axis (along an axis formed perpendicular to the series of alternating ridges and grooves).

Among other things, the corrugated corner elements and/or foldable corrugated corner elements of the present disclosure include at least one score mark formed extending substantially parallel to the longitudinal axis of the corrugated corner element. The score mark provides a line or portion along which the corrugated corner element may be bent or folded. By bending or folding the corrugated corner element along the score mark, a portion of the corrugated corner element can be urged from the formed to a more flattened position. By providing the corrugated corner elements in a more flattened position, the amount of space occupied by the corrugated corner element can be reduced and a greater number of corrugated corner elements can be packaged within a given shipment package.

In various exemplary, non-limiting embodiments, the foldable corrugated corner elements of the present disclosure include at least some of a portion of material extending continuously, substantially parallel to a longitudinal axis, from a first terminal end to a second terminal end, wherein the portion of material extends continuously, substantially parallel to a transverse axis, from a first corner element end to a second corner element end; a vertex extending substantially parallel to the longitudinal axis, between the first corner element end and the second corner element end; a first corner element leg, extending laterally from the vertex, the first corner element leg having one or more alternating ridges and grooves, each of the alternating ridges and grooves of the first corner element leg extending substantially parallel to the longitudinal axis of the foldable corrugated corner element; a second corner element leg, extending laterally from the vertex and away from the first corner element leg, the second corner element leg having one or more alternating ridges and grooves, each of the alternating ridges and grooves of the second corner element leg extending substantially parallel to the longitudinal axis of the foldable corrugated corner element; a notch formed in at least a portion of the first corner element leg extending from the first corner element end toward the vertex, wherein the notch is defined by converging sidewalls, wherein the converging sidewalls converge at a converging apex, wherein the notch allows the second corner element leg to be folded, along the transverse axis, such that at least a portion of one of the opposing sidewalls contacts or abuts at least a portion of the other opposing sidewall; one or more apertures formed through a portion of the second corner element leg, substantially along the transverse axis; and a hinge defined between adjacent apertures, wherein if the second corner element leg is folded, the apertures expand and each hinge provides an area of continuity for a portion of the second corner element leg.

In various other exemplary, non-limiting embodiments, the portion of material comprises a single layer of material.

In various other exemplary, non-limiting embodiments, the portion of material comprises a multi-layer portion of material.

In various other exemplary, non-limiting embodiments, the vertex is defined closer to the first corner element end than the second corner element end.

In various other exemplary, non-limiting embodiments, the vertex is defined closer to the second corner element end than the first corner element end.

In various other exemplary, non-limiting embodiments, each of the alternating ridges and grooves of the first corner element leg are alternating ridges and grooves, extending substantially parallel to the vertex and wherein each of the alternating ridges and grooves of the second corner element leg are alternating ridges and grooves, extending substantially parallel to the vertex.

In various other exemplary, non-limiting embodiments, the first corner element leg and the second corner element leg are each curvilinear along a respective length.

In various other exemplary, non-limiting embodiments, an inner wall of the first corner element leg and an inner wall of the second corner element leg comprises a sinusoidal succession of waves or curves.

In various other exemplary, non-limiting embodiments, the notch is a substantially V-shaped notch.

In various other exemplary, non-limiting embodiments, the notch is an indentation extending into at least a portion of the first corner element leg.

In various other exemplary, non-limiting embodiments, the transverse axis bisects the longitudinal axis at the converging apex.

In various other exemplary, non-limiting embodiments, the sidewalls expand away from the converging apex at 90° relative to one another, at less than 90° relative to one another, or at greater than 90° relative to one another.

In various other exemplary, non-limiting embodiments, the apertures are substantially elliptical, oval, or ovular.

In various other exemplary, non-limiting embodiments, the apertures are defined by substantially parallel aperture sidewalls.

In various other exemplary, non-limiting embodiments, the apertures are formed in portions of the ridges of an outer wall of the second corner element leg and the hinges are formed in portions of the grooves of the outer wall of the second corner element leg.

In various other exemplary, non-limiting embodiments, the apertures are formed in portions of the grooves of an outer wall of the second corner element leg and the hinges are formed in portions of the ridges of the outer wall of the second corner element leg.

In various other exemplary, non-limiting embodiments, a score mark formed in the portion of material, extending substantially parallel to the longitudinal axis, wherein the score mark provides a line or portion along which the foldable corrugated corner element may be bent or folded such that the foldable corrugated corner element may be more easily manipulated to a more flattened position.

In various exemplary, non-limiting embodiments, the foldable corrugated corner elements of the present disclosure include at least some of a portion of material extending substantially parallel to a longitudinal axis, from a first terminal end to a second terminal end, wherein the portion of material extends extending substantially parallel to a transverse axis, from a first corner element end to a second corner element end; a first corner element leg having one or more alternating ridges and grooves, each of the alternating ridges and grooves of the first corner element leg extending substantially parallel to the longitudinal axis of the foldable corrugated corner element; a second corner element leg, extending from the first corner element leg, the second corner element leg having one or more alternating ridges and grooves, each of the alternating ridges and grooves of the second corner element leg extending substantially parallel to the longitudinal axis of the foldable corrugated corner element; a notch formed in at least a portion of the first corner element leg extending from the first corner element end toward the vertex, wherein the notch is defined by converging sidewalls, wherein the converging sidewalls converge at a converging apex, wherein the notch allows the second corner element leg to be folded, along the transverse axis, until at least a portion of one of the opposing sidewalls contacts or abuts at least a portion of the other opposing sidewall; one or more apertures formed through a portion of the second corner element leg, substantially along the transverse axis; and a hinge defined between adjacent apertures, wherein if the second corner element leg is folded, the apertures expand and each hinge provides an area of continuity for a portion of the second corner element leg.

In various other exemplary, non-limiting embodiments, the score mark provides a line or portion along which the foldable corrugated corner element may be more easily manipulated to a more flattened position.

In various exemplary, non-limiting embodiments, the foldable corrugated corner elements of the present disclosure include at least some of a portion of material extending from a first terminal end to a second terminal end and from a first corner element end to a second corner element end; a vertex extending from the first terminal end to the second terminal end; a first corner element leg having one or more alternating ridges and grooves, each of the alternating ridges and grooves of the first corner element leg extending substantially parallel to the vertex; a second corner element leg, extending from the first corner element leg, the second corner element leg having one or more alternating ridges and grooves, each of the alternating ridges and grooves of the second corner element leg extending substantially parallel to the vertex; a foldable hinge portion extending from the first corner element end toward the vertex, wherein the foldable hinge portion is defined by two converging score marks and a bisecting score mark formed in at least a portion of the first corner element leg, wherein the converging score marks converge at a converging apex, wherein the converging score marks and the bisecting score mark allow portions of the foldable hinge portion to be comparatively more easily bent or folded such that the foldable hinge portion allows the second corner element leg to be folded, along the transverse axis, by allowing the portion of material between the converging score marks to fold away from an inner wall of the first corner element leg; one or more apertures formed through a portion of the second corner element leg, substantially along the transverse axis; and a hinge defined between adjacent apertures, wherein if the second corner element leg is folded, the apertures expand and each hinge provides an area of continuity for a portion of the second corner element leg.

Accordingly, the present disclosure separately and optionally provides foldable corrugated corner elements that can be folded along a transverse axis, perpendicular to a series of alternating ridges and grooves.

The present disclosure separately and optionally provides foldable corrugated corner elements that can be easily stored in a relatively compact configuration, awaiting assembly and use.

The present disclosure separately and optionally provides foldable corrugated corner elements that can be easily assembled or constructed, when needed.

The present disclosure separately and optionally provides foldable corrugated corner elements that provides lower costs for handling and storage.

The present disclosure separately and optionally provides foldable corrugated corner elements with a high degree of compressional strength.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein. However, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
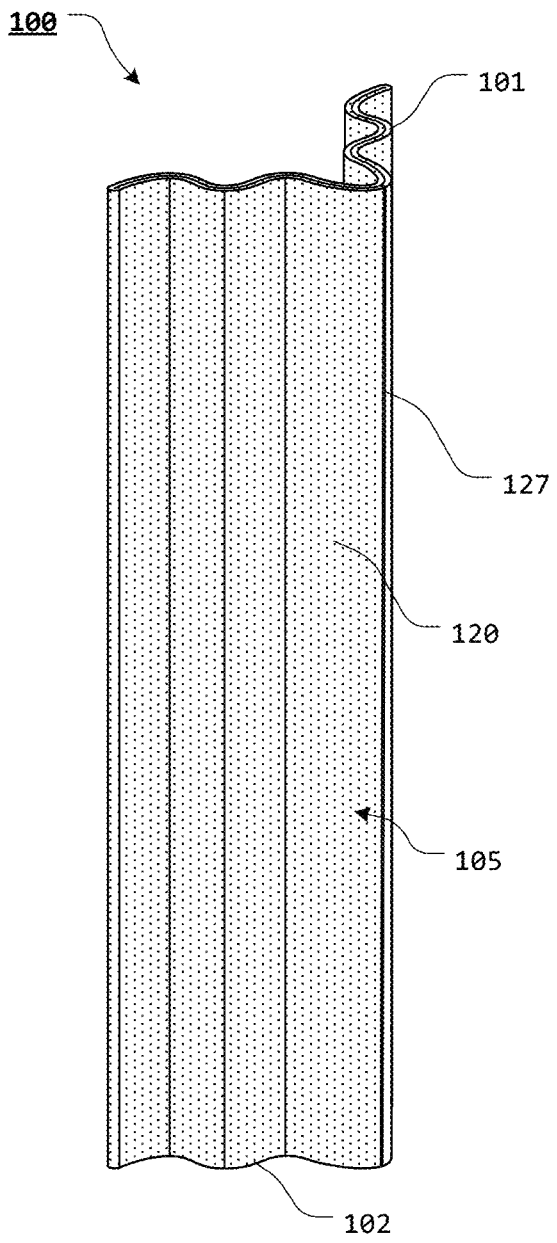
FIG. 1 illustrates a rear perspective view of an exemplary embodiment of a corrugated corner element, according to the present disclosure.
Figure 2:
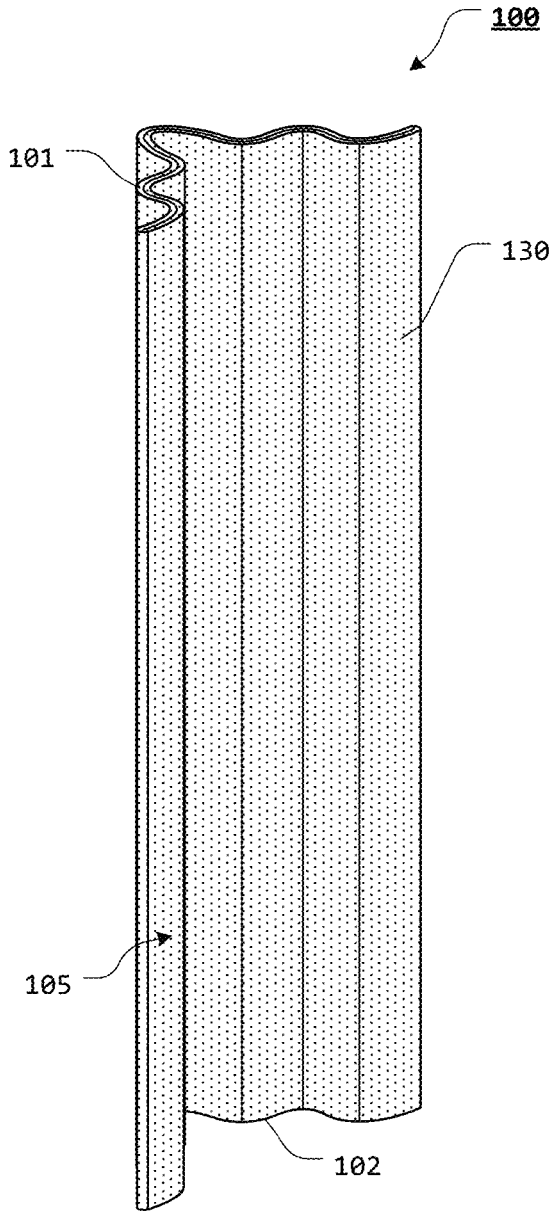
FIG. 2 illustrates a front perspective view of an exemplary embodiment of a corrugated corner element, according to the present disclosure.
Figure 3:
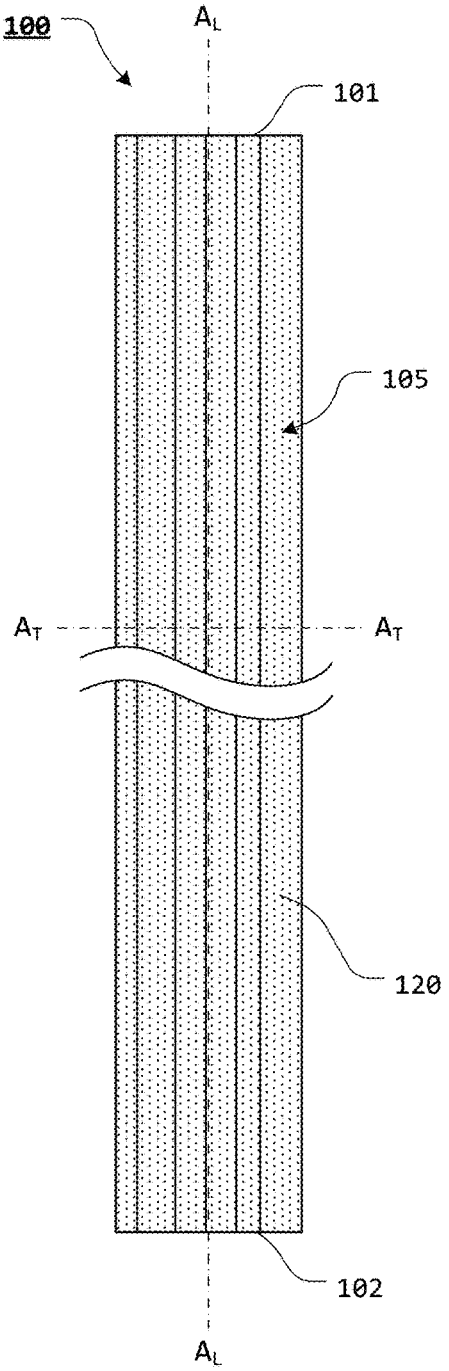
FIG. 3 illustrates a rear view of an exemplary embodiment of a corrugated corner element, according to the present disclosure, the front view of the exemplary embodiment of the corrugated corner element is a mirror image of the front view.

For simplicity and clarification, the design factors and operating principles of the foldable corrugated corner elements are explained with reference to various exemplary embodiments of foldable corrugated corner elements according to the present disclosure. The basic explanation of the design factors and operating principles of the foldable corrugated corner elements is applicable for the understanding, design, and operation of the foldable corrugated corner elements of the present disclosure. It should be appreciated that the foldable corrugated corner elements can be adapted to many applications where a packaging assembly can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "corner element", "corrugated corner element", "foldable corrugated corner element", and "scored corrugated corner element" are used for basic explanation and understanding of the operation of the systems, methods, and apparatuses of the present disclosure. Therefore, the terms "corner element", "corrugated corner element", "foldable corrugated corner element", and "scored corrugated corner element" are not to be construed as limiting the systems, methods, and apparatuses of the present disclosure.

As used herein, the longitudinal axis, $A_L$, is the long axis of an object or structure, running the length of the object or structure, while the transverse axis, $A_T$, extends substantially perpendicular to the longitudinal axis, $A_L$.

Turning now to the appended drawing figures, FIGS. 1-7 illustrate certain elements and/or aspects of exemplary embodiments of a corrugated corner element 100, according to the present disclosure. FIGS. 8-31 illustrate certain elements and/or aspects of exemplary embodiments of a foldable corrugated corner element 200, according to the present disclosure. FIGS. 32-39 illustrate certain elements and/or aspects of exemplary embodiments of a foldable corrugated corner element 300, according to the present disclosure. FIGS. 40-43 illustrate certain elements and/or aspects of exemplary embodiments of a foldable corrugated corner elements 400, according to the present disclosure.

As illustrated most clearly in FIGS. 1-7, the corrugated corner element 100 optionally comprises an elongate portion of material or a sheet 105 that extends, substantially parallel to a longitudinal axis, $A_L$, from a first terminal end 101 to a second terminal end 102. In various exemplary embodiments, the corrugated corner element 100 extends continuously, in an uninterrupted manner, from the first terminal end 101 to the second terminal end 102. Alternatively, one or more notches, recesses, or depressions may optionally be formed in one or more areas, along the corrugated corner element 100, between the first terminal end 101 and the second terminal end 102.

The portion of material or sheet 105 also extends continuously, extending substantially parallel to a transverse axis, $A_T$, from a first corner element end 128 to a second corner element end 129.

In various exemplary embodiments, the corrugated corner element 100 is formed of a portion of material or a sheet 105. In certain exemplary embodiments, the material used to form the sheet 105 comprises a single layer of material. Alternatively, the material used to form sheet 105 comprises multiple layers of similar or dissimilar materials joined or adhesively bonded together to form the sheet 105. Thus, it should be appreciated that the sheet 105 may comprise a single layer of material or may be a multi-layer sheet 105 formed of a laminate of a plurality of layers of material attached or coupled by an adhesive or other means.

The sheet 105 may also be formed of paperboard, chipboard, container board, box board, cardboard, or corrugated fiberboard.

A vertex 122 is defined along the corrugated corner element 100. The vertex 122 generally extends, extending substantially parallel to the longitudinal axis, $A_L$, from the first terminal end 101 to the second terminal end 102. The vertex 122 defines a line from which the first corner element leg 110 and the second corner element leg 112 extend. In certain exemplary, non-limiting embodiments, the vertex 122 bisects the corrugated corner element 100, extending substantially parallel to the longitudinal axis, $A_L$, proximate a center of each of the corrugated corner element 100. Generally, the vertex 122 defines the furthest extent of the first corner element end 128 and the second corner element end 129.

The first corner element leg 110 extends continuously, laterally from the vertex 122 to a first corner element end 128, while the second corner element leg 112 extends laterally from the vertex 122 to a second corner element end 129. The second corner element end 129 extends laterally from the vertex 122, in a direction that is generally away from the direction that the first corner element end 128 extends laterally from the vertex 122.

In certain exemplary, nonlimiting embodiments, substantially straight lines from the vertex 122 to the respective first corner element end 128 and from the vertex 122 to the second corner element end 129 are at approximately 90° relative to one another.

Figure 4:
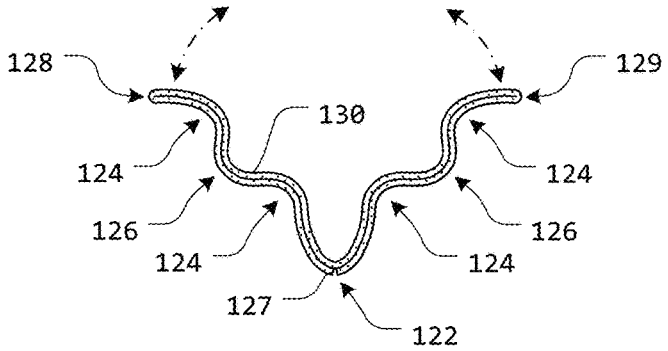
FIG. 4 illustrates a left side view of an exemplary embodiment of a corrugated corner element, according to the present disclosure.
Figure 5:
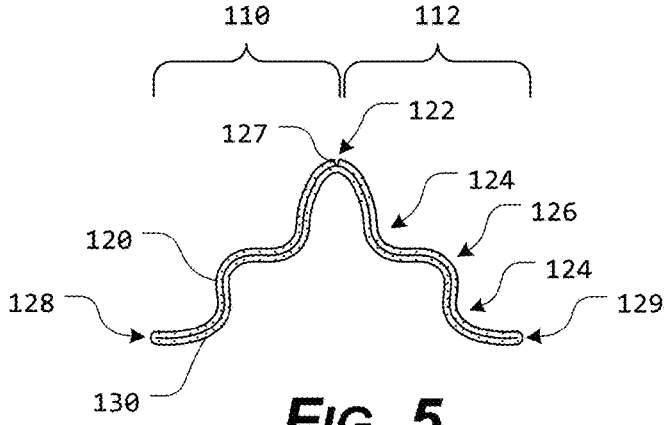
FIG. 5 illustrates a right side view of an exemplary embodiment of a corrugated corner element, according to the present disclosure.

Typically, when viewed from the left side or the right side, as illustrated in FIGS. 4 and 5, respectively, the first corner element leg 110 includes one or more alternating ridges 126 and grooves 124, formed along its length. Likewise, the second corner element leg 112 includes one or more alternating ridges 126 and/or grooves 124, along its length. Each of the alternating ridges 126 and grooves 124 of the first corner element leg 110 extends, extending substantially parallel to or extending substantially parallel to the longitudinal axis, $A_L$, of the corrugated corner element 100. In certain exemplary, nonlimiting embodiments, each of the alternating ridges 126 and grooves 124 are extending substantially parallel and alternating ridges 126 and grooves 124.

By including the alternating ridges 126 and grooves 124, the first corner element leg 110 and the second corner element leg 112 is curvilinear along its respective length, from the vertex 122 to the respective first corner element end 128 and from the vertex 122 to the second corner element end 129. The alternating ridges 126 and grooves 124 may be formed such that the first corner element leg 110 and the second corner element leg 112 each comprise a sinusoidal succession of waves or curves, along the respective lengths, from the vertex 122 to the respective first corner element end 128 and from the vertex 122 to the second corner element end 129.

As illustrated, a transverse cross-section of the second corner element leg 112 forms a mirror image of a transverse cross-section of the first corner element legs 110. However, it should be appreciated that it is not necessary for the transverse cross-section of the second corner element leg 112 to form a mirror image of a transverse cross-section of the first corner element legs 110. Thus, a transverse cross-section of the second corner element leg 112 may have alternating ridges 126 and grooves 124 that are not mirror images of the alternating ridges 126 and grooves 124 of a transverse cross-section of the first corner element legs 110.

An outer wall 120 forms an exterior surface of the corrugated corner element 100, while an inner wall 130 forms and interior surface of the corrugated corner element 100. As used herein, the terms "outer", "exterior", "inner", and "interior" are used for reference only and are not to be viewed as limiting the present disclosure. In certain exemplary, non-limiting embodiments, the outer wall 120 of the corrugated corner element 100 is substantially coextensive with the inner wall 130 of the corrugated corner element 100.

Because of the inclusion of the alternating ridges 126 and grooves 124, the corrugated corner element 100 is even better able to resist left to right compression, extending substantially parallel to the longitudinal axis, $A_L$, of the corrugated corner element 100. Additionally, the inclusion of the alternating ridges 126 and grooves 124 help each of the first corner element leg 110 and second corner element leg 112 to better resist crushing, when forces are applied to the outer wall 120 and/or the inner wall 130.

At least the vertex 122 and possibly the alternating ridges 126 and grooves 124 allow for a degree of inward flexion and resilient recovery toward the original shape of the first corner element leg 110 relative to the second corner element leg 112, as illustrated by the semicircular arrows in FIG. 4.

The structure or grain of the corrugated corner element 100 or the sheet 105 may make it difficult to create an even bend or fold along a portion of the corrugated corner element 100 or the sheet 105. Providing a score mark 127 allows the material of the corrugated corner element 100 or the sheet 105 to form or more easily form a bend or fold or more easily form an even or consistent bend or fold.

In certain exemplary, nonlimiting embodiments, a score mark 127, formed of a complete or partial recess or depression in the portion of material or sheet 105 or formed of a complete or partial perforation formed in the portion of material or sheet 105 extending substantially parallel to or extending substantially parallel to the longitudinal axis, $A_L$, of the corrugated corner element 100.

In various exemplary embodiments, the score mark 127 may be formed of a compressed area of the corrugated corner element 100, without creating a cut. Alternatively, the score mark 127 may be formed of a partial cut through the portion of material or sheet 105.

In certain exemplary embodiments, the score mark 127 is formed in a portion of the outer wall 120 or exterior surface of the corrugated corner element 100. Alternatively, the score mark 127 may optionally be formed in a portion of the inner wall 130 or interior surface of the corrugated corner element 100.

In certain exemplary embodiments, the score mark 127 extends from the first terminal end 101 to the second terminal end 102. Alternatively, the score mark 127 may extend from an area proximate the first terminal end 101 to an area proximate the second terminal end 102.

The score mark 127 provides a line or portion along which the corrugated corner element 100 may be comparatively more easily bent or folded, whether along the grain or against the grain of the corrugated corner element 100 or the sheet 105. Thus, the score mark 127 may optionally provide a compressed or weakened area or portion of the corrugated corner element 100, along which the corrugated corner element 100 may be comparatively more easily bent or folded.

Figure 6:
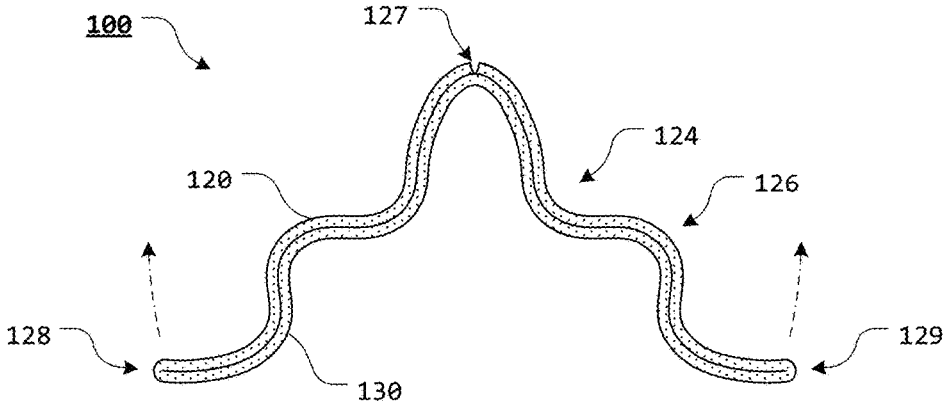
FIG. 6 illustrates a right side view of an exemplary embodiment of a corrugated corner element, wherein the corrugated corner element is in a formed position, according to the present disclosure.
Figure 7:
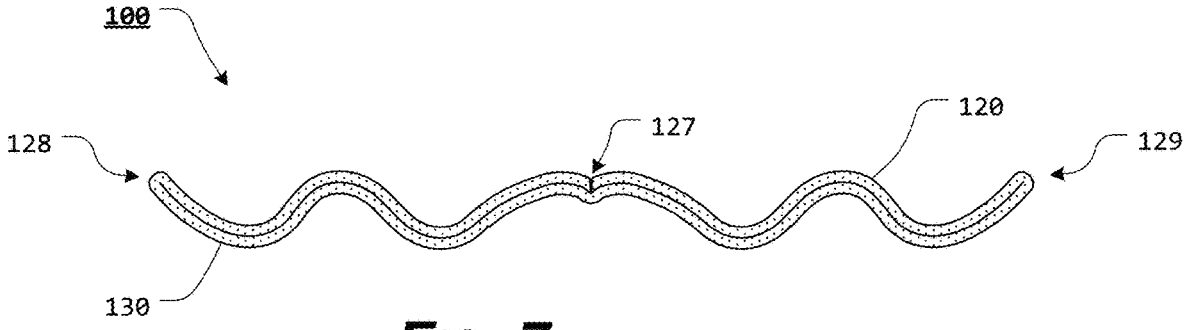
FIG. 7 illustrates a right side view of an exemplary embodiment of a corrugated corner element, wherein the corrugated corner element is in a more flattened position, according to the present disclosure.
Figure 8:
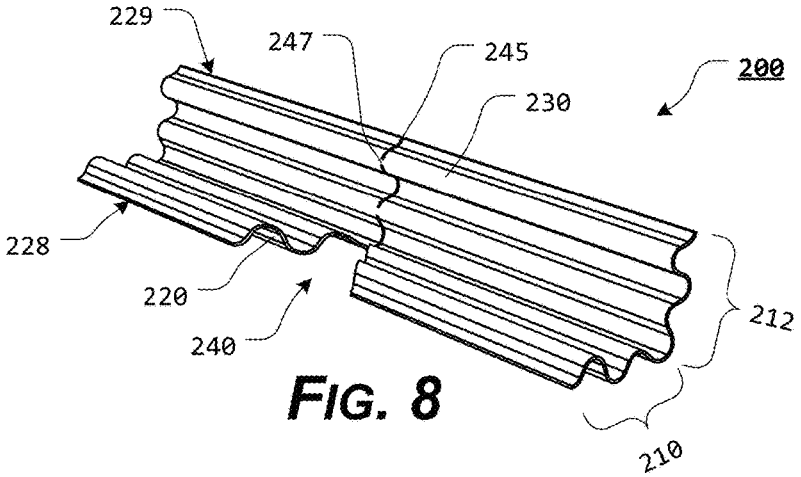
FIG. 8 illustrates a top, right, perspective view of an exemplary embodiment of a foldable corrugated corner element, according to the present disclosure.
Figure 9:
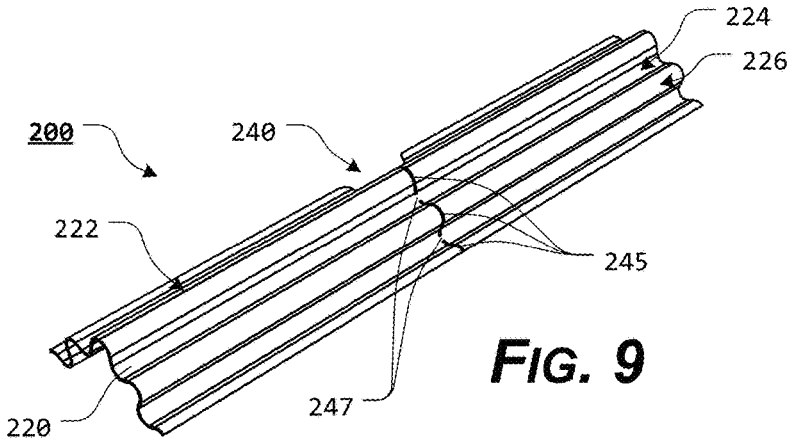
FIG. 9 illustrates a lower, rear, left, perspective view of an exemplary embodiment of a foldable corrugated corner element, according to the present disclosure.
Figure 10:
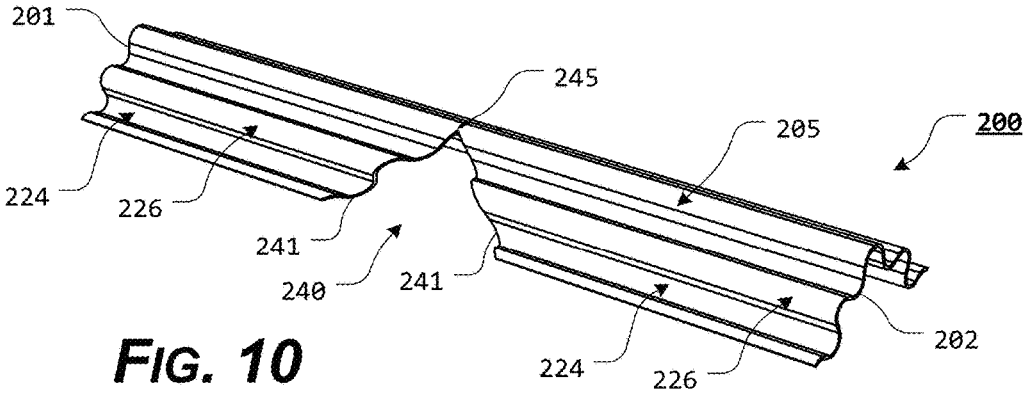
FIG. 10 illustrates a bottom, left, perspective view of an exemplary embodiment of a foldable corrugated corner element, according to the present disclosure.
Figure 11:
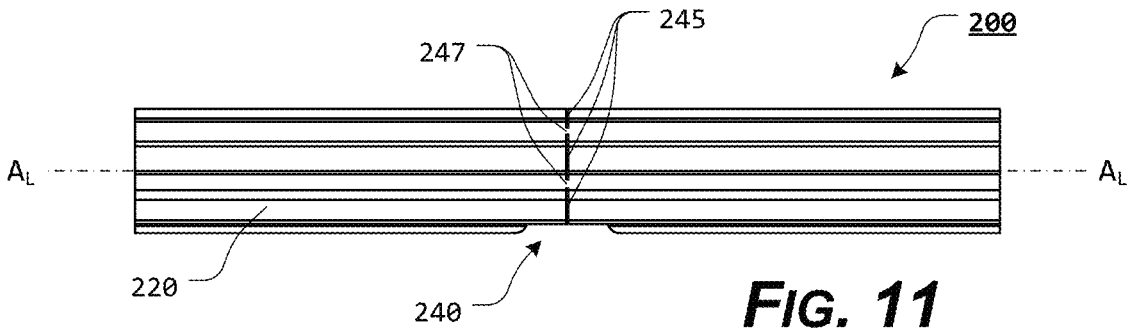
FIG. 11 illustrates a rear view of an exemplary embodiment of a foldable corrugated corner element, according to the present disclosure.
Figure 12:
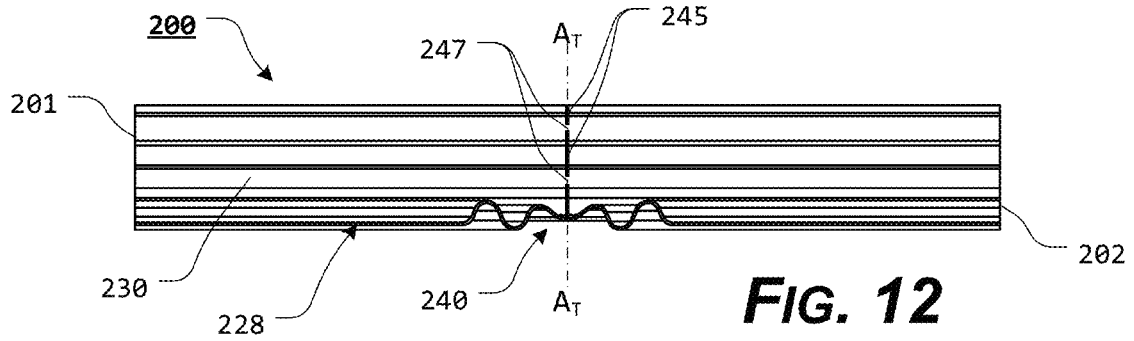
FIG. 12 illustrates a front view of an exemplary embodiment of a foldable corrugated corner element, according to the present disclosure.
Figure 13:
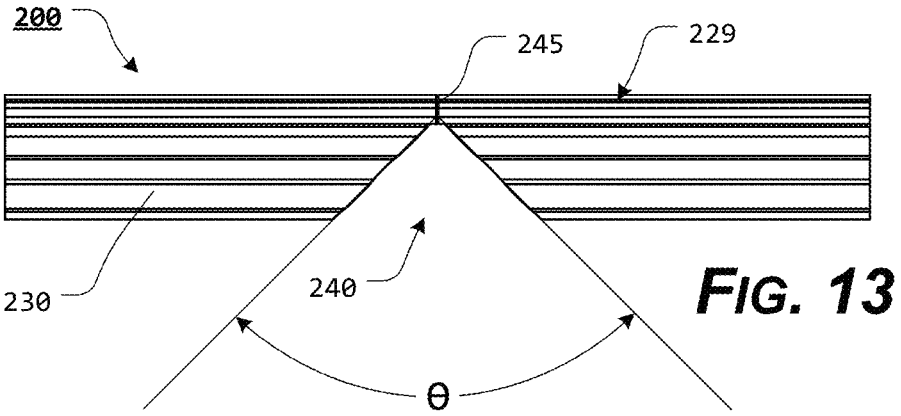
FIG. 13 illustrates a top view of an exemplary embodiment of a foldable corrugated corner element, according to the present disclosure.
Figure 14:
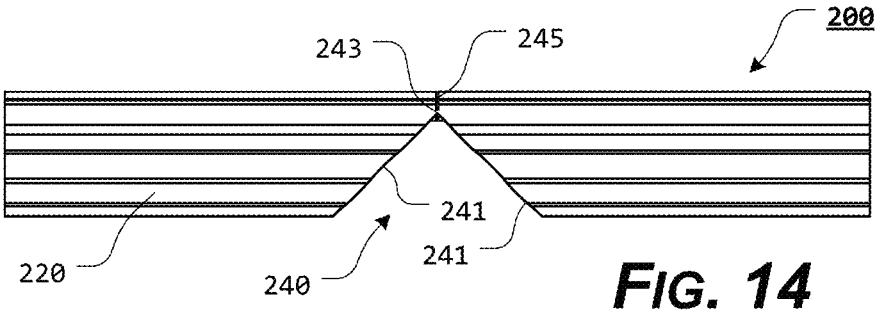
FIG. 14 illustrates a bottom view of an exemplary embodiment of a foldable corrugated corner element, according to the present disclosure.
Figure 15:
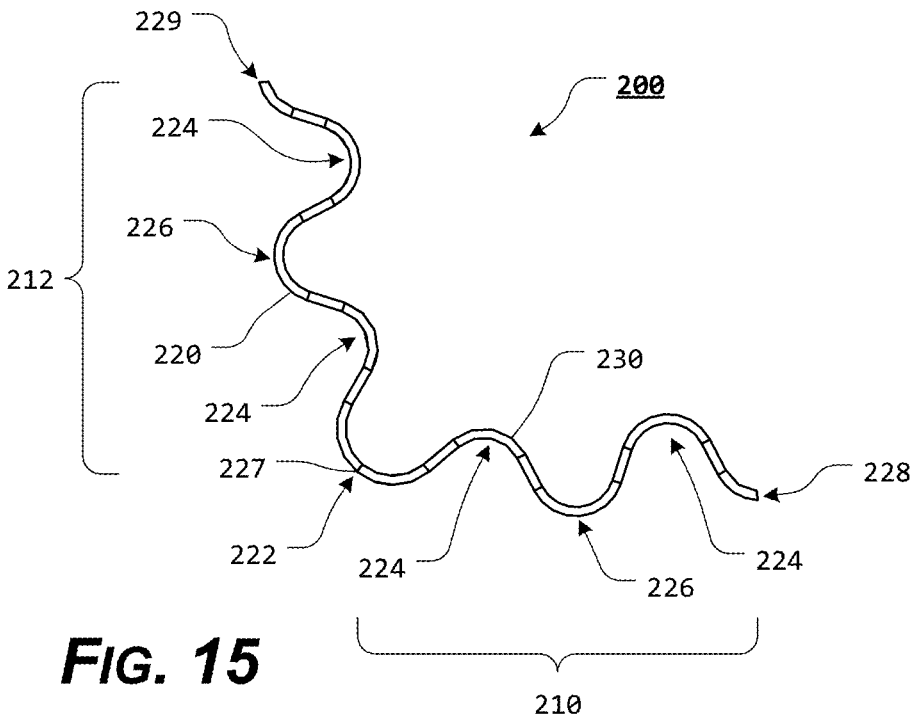
FIG. 15 illustrates a left side view of an exemplary embodiment of a foldable corrugated corner element, according to the present disclosure.
Figure 16:
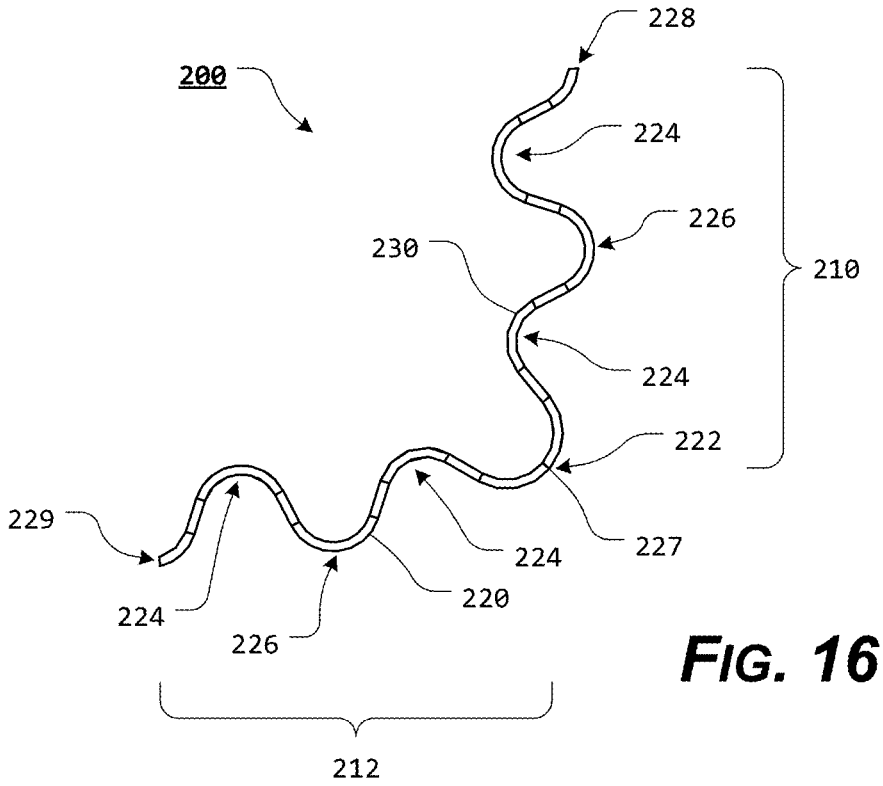
FIG. 16 illustrates a right side view of an exemplary embodiment of a foldable corrugated corner element, according to the present disclosure.

By bending or folding the corrugated corner element 100 along the score mark 127, as illustrated by the semicircular arrows in FIG. 6, a portion of the corrugated corner element 100 can be more easily manipulated to the more flattened position, as illustrated in FIG. 7. In certain embodiments, a plurality of score marks 127 may be formed at spaced apart locations extending substantially parallel to the longitudinal axis, $A_L$, of the corrugated corner element 100.

By optionally positioning the score mark 127 proximate the vertex 122, a single fold of the corrugated corner element 100 can allow the corrugated corner element 100 to be manipulated to a more flattened position. Once in the more flattened position, corrugated corner element 100 can be positioned atop one another and alternating ridges 126 of a first corrugated corner element 100 can be "nested" within at least a portion of certain alternating grooves 124 of a second corrugated corner element 100. Thus, the area required for the corrugated corner element 100 is altered, to allow corrugated corner element 100 to be more densely packaged in a particular packaging container.

In certain exemplary embodiments, as illustrated most clearly in FIGS. 1-7, the score mark 127 may optionally be formed proximate a center of the corrugated corner element 100, as defined between the first corner element end 128 and the second corner element end 129. Alternatively, the score mark 127 may optionally be formed in an area other than the proximate center of the corrugated corner element 100, more proximate the first corner element end 128 or the second corner element end 129.

In various exemplary embodiments, the corrugated corner element 100 is substantially rigid and is formed of cardboard. Alternate materials of construction of the corrugated corner element 100 may include one or more of the following: thick paper (of various types), pasteboard, paperboard, container board, corrugated fiberboard, box board, or chipboard. In still other exemplary embodiments, alternate materials of construction of the corrugated corner element 100 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the corrugated corner element 100 is a design choice based on the desired appearance and functionality of the corrugated corner element 100.

The corrugated corner element 100 may be constructed having an any desired overall size or shape. It should also be understood that the overall size and shape of the corrugated corner element 100, and the various portions thereof, is a design choice based upon the desired functionality, compatibility with desired articles or products and/or appearance of the corrugated corner element 100.

Thus, it should be appreciated that the overall length, width, and/or height of the first corner element leg 110 and the second corner element leg 112 is a design choice, based upon the desired degree of packaging or cushioning provided by the corrugated corner element 100 and/or the size and shape of the packaged article or product with which the corrugated corner element 100 is to be utilized.

In certain exemplary, nonlimiting embodiments, at least a portion of the outer wall 120 and/or the inner wall 130 may be textured or may include an adhesive portion to provide a surface or area having a desired degree of friction or adhesive bonding relative to a product or product packaging. Thus, at least a portion of the corrugated corner element 100 may be formed so as to resist movement of the corrugated corner element 100 relative to a surface.

Once used as packaging for an article or product, one or more apexes of alternating ridges 126 make contact portions of the surface of the interior of the product packaging and the packaged article or product to maintain the packaged article or product in a desired position relative to the product packaging and provide package cushioning or support to the packaged article or product during shipping, transport, or storage.

During shipping, transport, or storage of the packaged article or product, the corrugated corner element 100 helps to resist movement of the packaged article or product within the product packaging. Additionally, if the product packaging is bumped or jarred, causing the packaged article or product to shift within the product packaging, the alternating ridges 126 and grooves 124 allow for a degree of inward and/or outward flexion and resilient recovery toward the original shape of the corrugated corner element 100.

It should be appreciated that the corrugated corner element 100 of the present disclosure is not limited to the embodiments illustrated and described in FIGS. 1-7. For example, FIGS. 8-43 illustrate certain components, elements, and/or aspects of certain exemplary embodiments of foldable corrugated corner elements 200, 300, and 400, according to the present disclosure.

FIGS. 8-31 illustrate certain elements and/or aspects of exemplary embodiments of a foldable corrugated corner element 200, according to the present disclosure. As illustrated in FIGS. 8-31, the foldable corrugated corner element 200 comprise an elongate portion of material or a sheet 205, extending substantially parallel to a longitudinal axis, $A_L$, from a first terminal end 201 to a second terminal end 202 and extending substantially parallel to a transverse axis, $A_T$, from a first corner element end 228 to a second corner element end 229, a vertex 222, a first corner element leg 210, a second corner element leg 212, an outer wall 220, an inner wall 230, one or more alternating ridges 226 and/or grooves 224, and an optional score mark 227.

It should be appreciated that these elements correspond to and operate similarly to the sheet 105, the first terminal end 101, the second terminal end 102, the first corner element end 128, the second corner element end 129, the vertex 122, the first corner element leg 110, the second corner element leg 112, the outer wall 120, the inner wall 130, the one or more alternating ridges 126 and/or grooves 124, and the optional score mark 127, as described herein, with reference to the corrugated corner element 100.

However, as illustrated in FIGS. 8-31, the foldable corrugated corner element 200 further includes a void in the form of a substantially V-shaped notch 240 formed in or formed of an indentation extending into at least a portion of the first corner element leg 210 and one or more cuts through at least a portion of the second corner element leg 212, defining alternating apertures 245 and hinges 247 in a portion of the second corner element leg 212.

It should be appreciated that while the notch 240 is shown and described as being formed through at least a portion of the first corner element leg 210 and the one or more alternating apertures 245 and hinges 247 are shown and described as being formed through a portion of the second corner element leg 212, the present disclosure is not so limited. Thus, in various exemplary embodiments, the notch 240 may optionally be formed through at least a portion of the second corner element leg 212 and the one or more alternating apertures 245 and hinges 247 may optionally be formed through a portion of the first corner element leg 210.

The notch 240 is defined by sidewalls 241. The sidewalls 241 extend from the first corner element end 128 toward the vertex 222 and converge proximate, at, or beyond the vertex 222, at a converging apex 243. The sidewalls 241 converge so as to create a notch 240 having an angle θ. In various exemplary embodiments, the angle θ is 90°, so that the sidewalls 241 extend at 90° relative to one another.

The converging apex 243 of the notch 240 defines where the transverse axis, $A_T$, bisects the longitudinal axis, $A_L$.

By providing the sidewalls 241 at an angle θ of 90°, the foldable corrugated corner element 200 may be folded, along the transverse axis, $A_T$, until at least a portion of one of the opposing sidewalls 241 contacts or abuts at least a portion of the other opposing sidewall 241, to provide a 90° bend in the second corner element leg 212. It should be appreciated that the angle θ may be greater than 90°, equal to 90°, or less than 90°. Thus, the notch 240 may include sidewalls 241 formed at any desired angle relative to one another. In this manner, portions of the second corner element leg 212 may be bent, along the transverse axis, $A_T$, at any desired angle. For example, if the angle θ is 45°, the sidewalls 241 are formed at 45° relative to one another and portions of the second corner element leg 212 may be bent, along the transverse axis, $A_T$, so that the resultant portions of the second corner element leg 212 are at 45° relative to one another when at least a portion of one of the opposing sidewalls 241 contacts or abuts at least a portion of the other opposing sidewall 241.

It should be appreciated that the foldable corrugated corner element 200 may be bent such that at least a portion of one of the opposing sidewalls 241 may optionally at least partially overlap a portion of the other opposing sidewall 241. Alternatively, the foldable corrugated corner element 200 may be bent such that neither of the opposing sidewalls 241 contacts the other opposing sidewall 241 or overlap a portion of the other opposing sidewall 241.

Because of the structure of the second corner element leg 212, particularly the series of alternating ridges 226 and/or grooves 224 formed substantially perpendicular to the transverse axis, $A_T$, it can be difficult to bend the second corner element leg 212 along the transverse axis, $A_T$. In order to allow for easier bending of the second corner element leg 212 along the transverse axis, $A_T$, the one or more alternating apertures 245 and hinges 247 are formed along a portion of the second corner element leg 212.

The length or depth of adjacent apertures 245 defines the length of the hinge 247 formed between the adjacent apertures 245. Thus, the amount of material provided by each hinge 247 can be dictated by the length or depth of the various apertures 245 formed in the second corner element leg 212.

Figure 17:
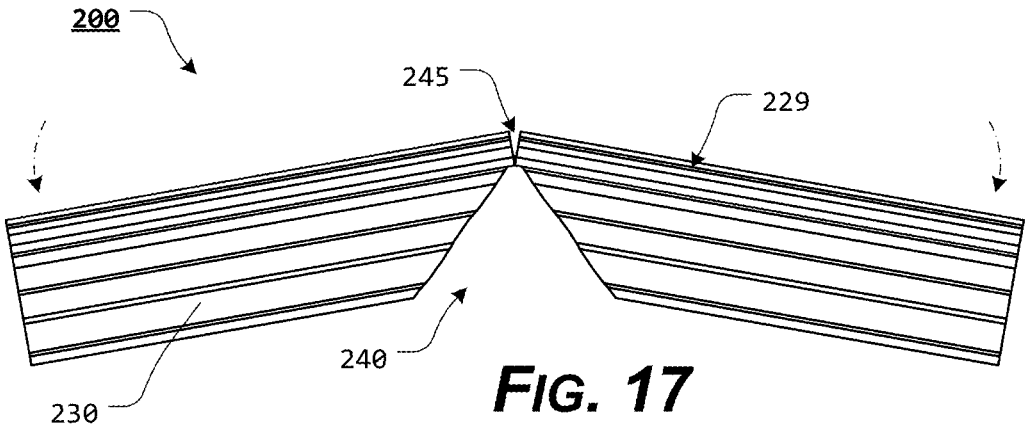
FIG. 17 illustrates a top view of an exemplary embodiment of a foldable corrugated corner element in a partially folded position, according to the present disclosure.
Figure 18:
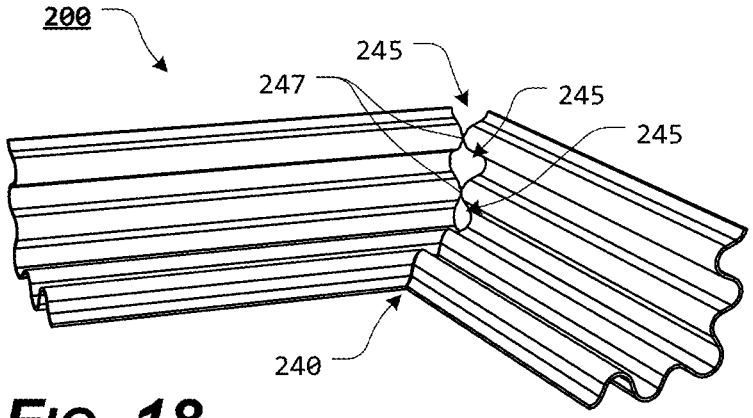
FIG. 18 illustrates an upper, right, front, perspective view of an exemplary embodiment of a foldable corrugated corner element in a folded position, according to the present disclosure.
Figure 19:
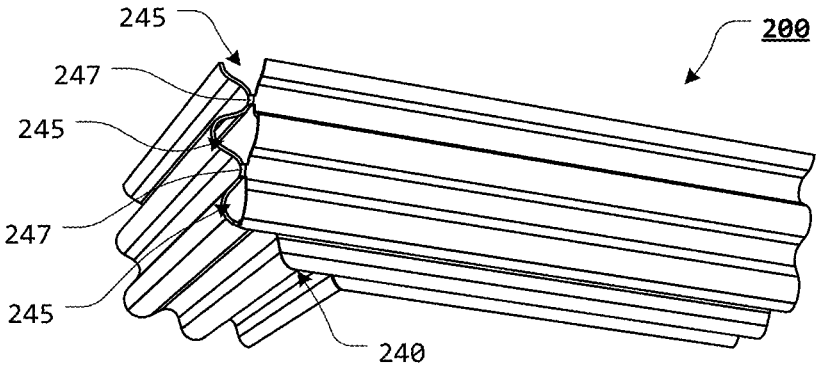
FIG. 19 illustrates a bottom, left, rear, perspective view of an exemplary embodiment of a foldable corrugated corner element in a folded position, according to the present disclosure.
Figure 20:
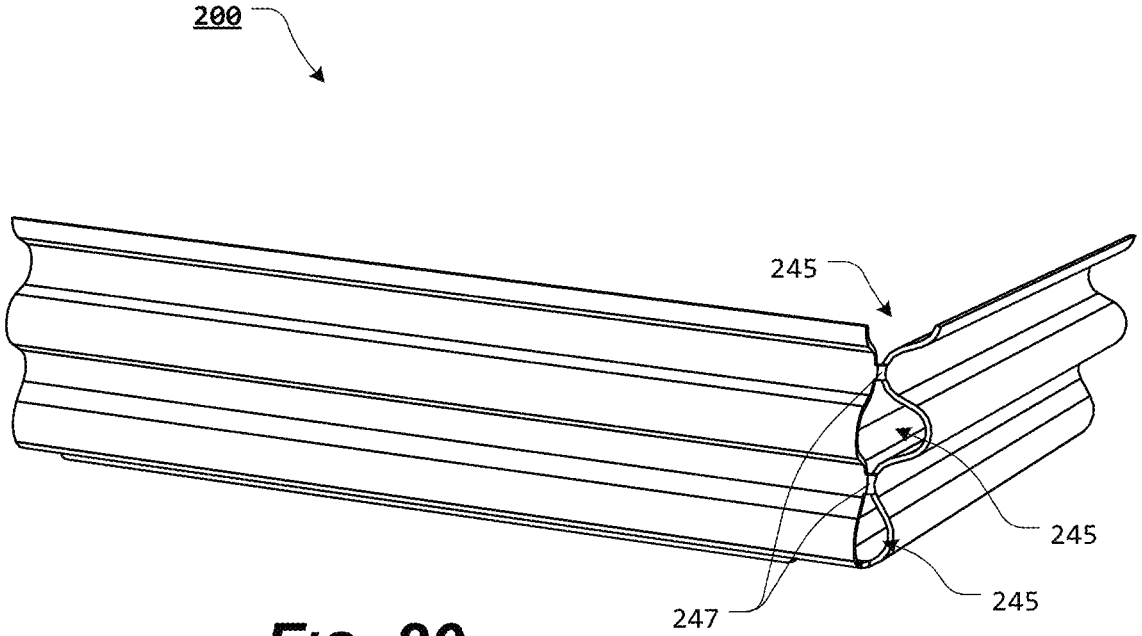
FIG. 20 illustrates a right, rear, perspective view of an exemplary embodiment of a foldable corrugated corner element in a folded position, according to the present disclosure.
Figure 21:
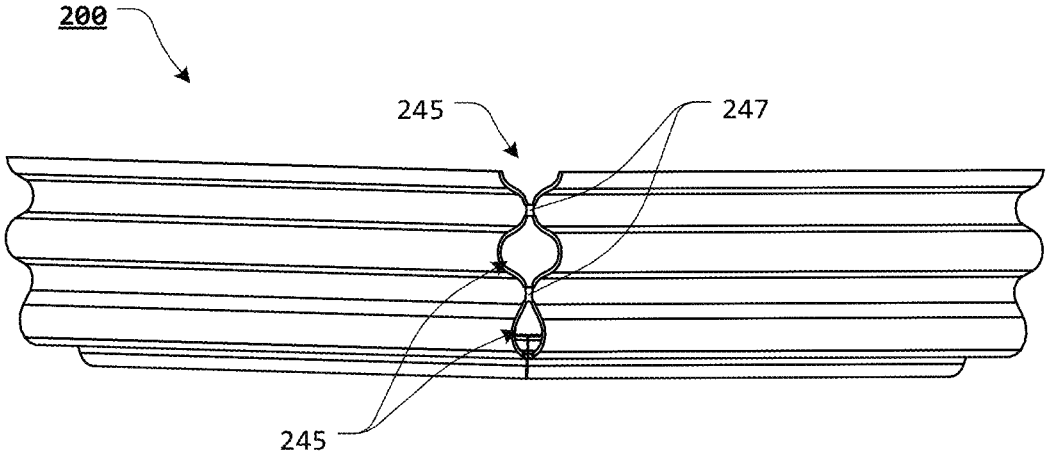
FIG. 21 illustrates a rear, perspective view of an exemplary embodiment of a foldable corrugated corner element in a folded position, according to the present disclosure.
Figure 22:
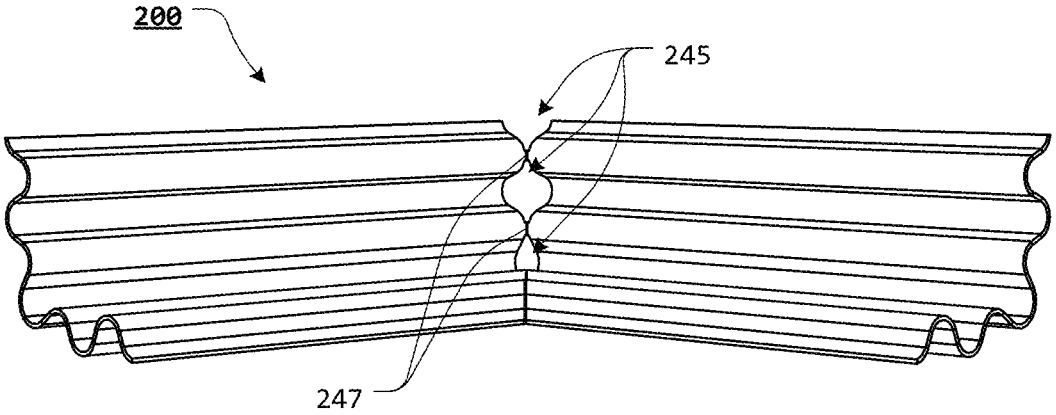
FIG. 22 illustrates a front, perspective view of an exemplary embodiment of a foldable corrugated corner element in a folded position, according to the present disclosure.
Figure 23:
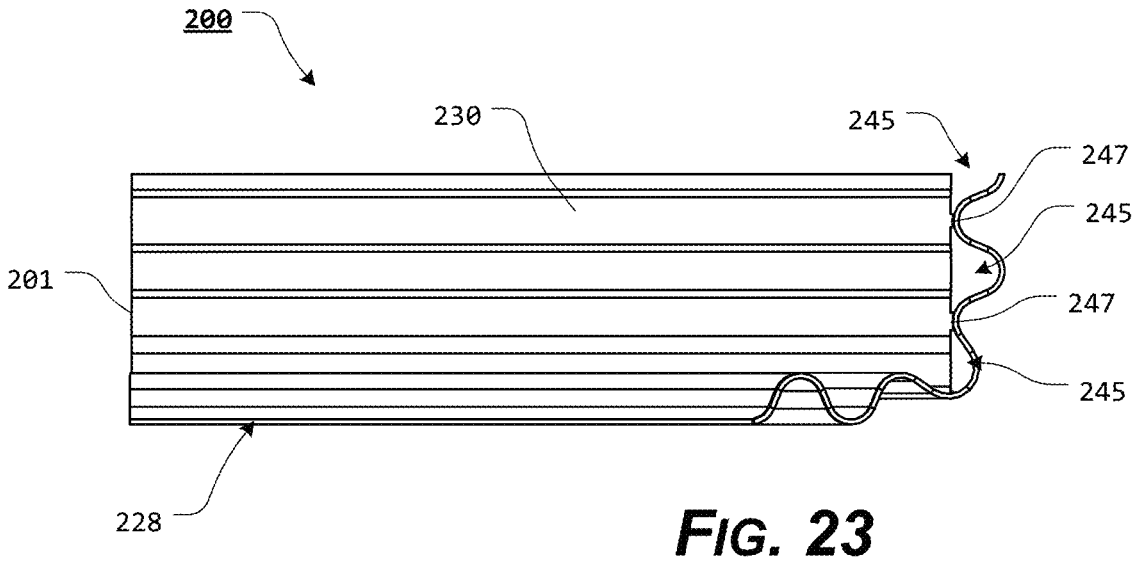
FIG. 23 illustrates a right, front view of an exemplary embodiment of a foldable corrugated corner element in a folded position, according to the present disclosure.
Figure 24:
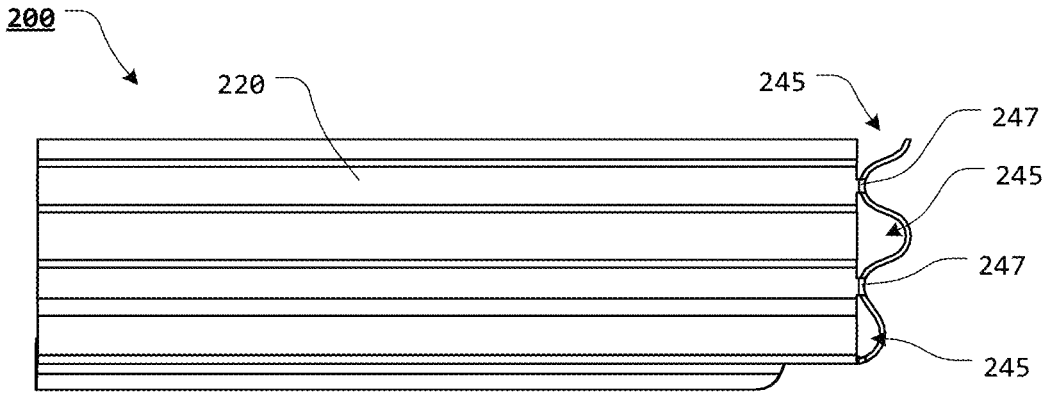
FIG. 24 illustrates a right, rear view of an exemplary embodiment of a foldable corrugated corner element in a folded position, according to the present disclosure.
Figure 25:
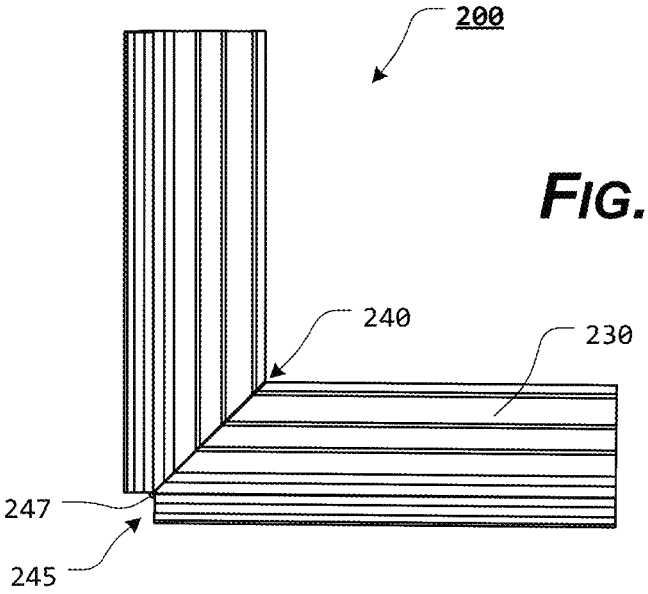
FIG. 25 illustrates a top view of an exemplary embodiment of a foldable corrugated corner element in a folded position, according to the present disclosure.
Figure 26:
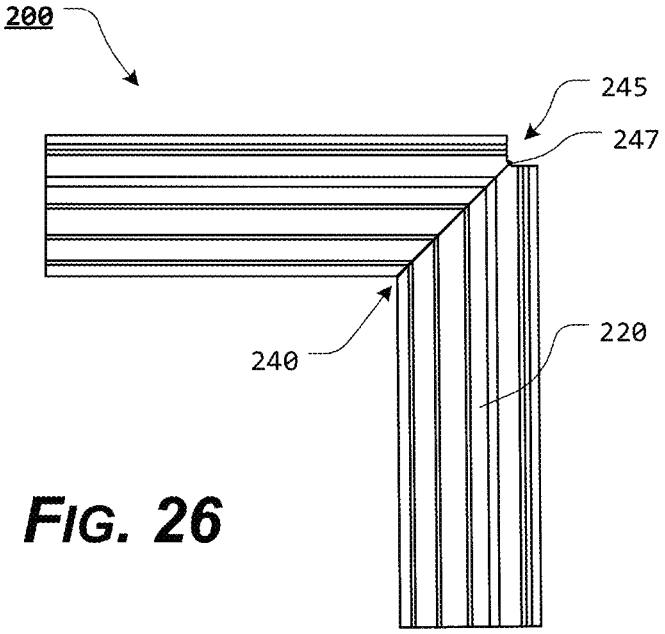
FIG. 26 illustrates a bottom view of an exemplary embodiment of a foldable corrugated corner element in a folded position, according to the present disclosure.
Figure 27:
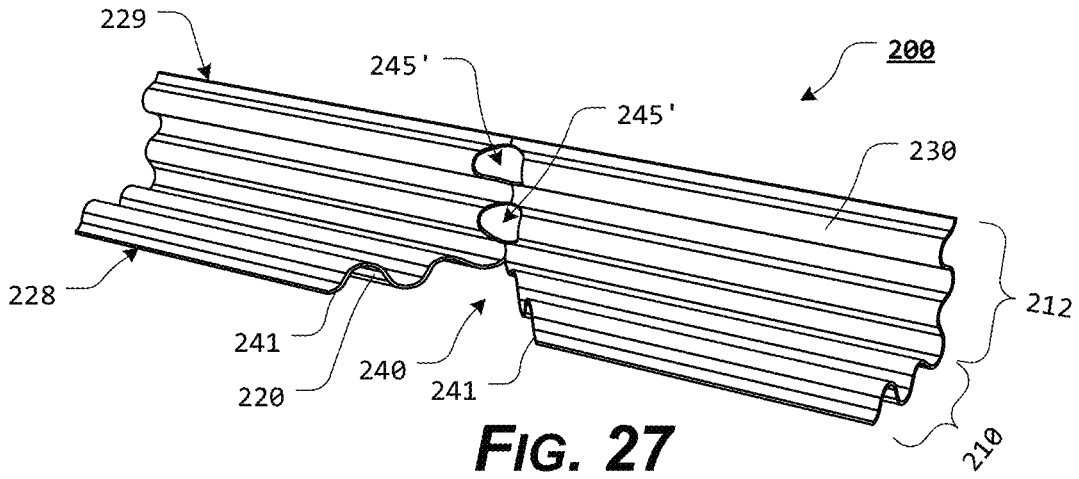
FIG. 27 illustrates a top, right, perspective view of an exemplary embodiment of a foldable corrugated corner element, according to the present disclosure.
Figure 28:
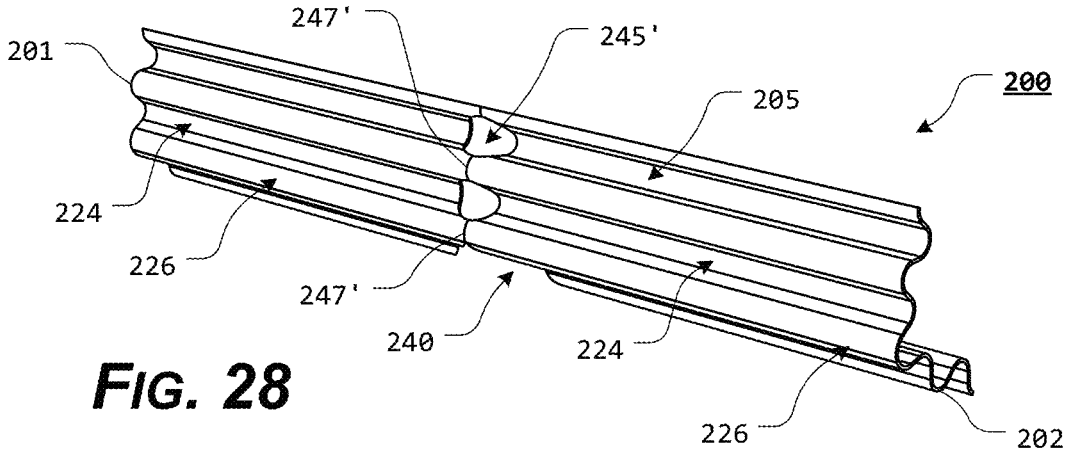
FIG. 28 illustrates an upper, rear, left, perspective view of an exemplary embodiment of a foldable corrugated corner element, according to the present disclosure.
Figure 29:
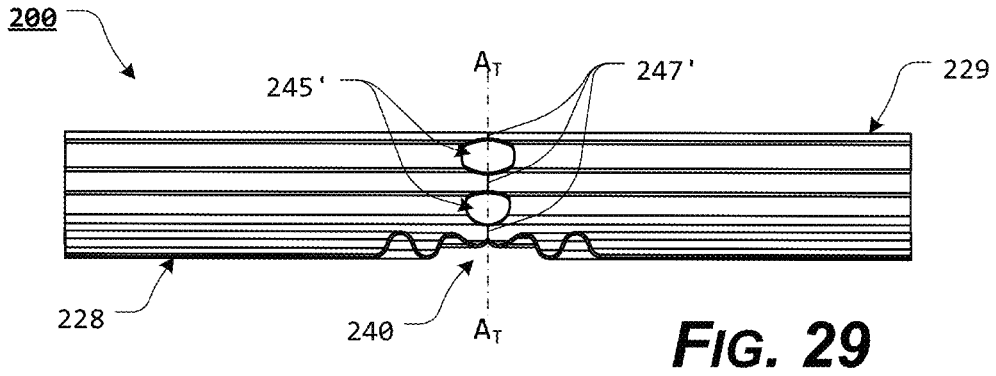
FIG. 29 illustrates a front view of an exemplary embodiment of a foldable corrugated corner element, according to the present disclosure.
Figure 30:
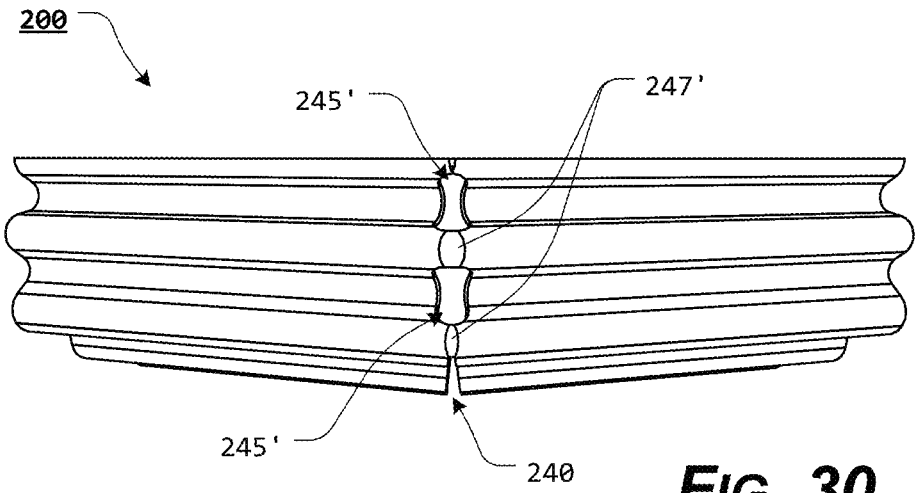
FIG. 30 illustrates a rear, perspective view of an exemplary embodiment of a foldable corrugated corner element in a folded position, according to the present disclosure.
Figure 31:
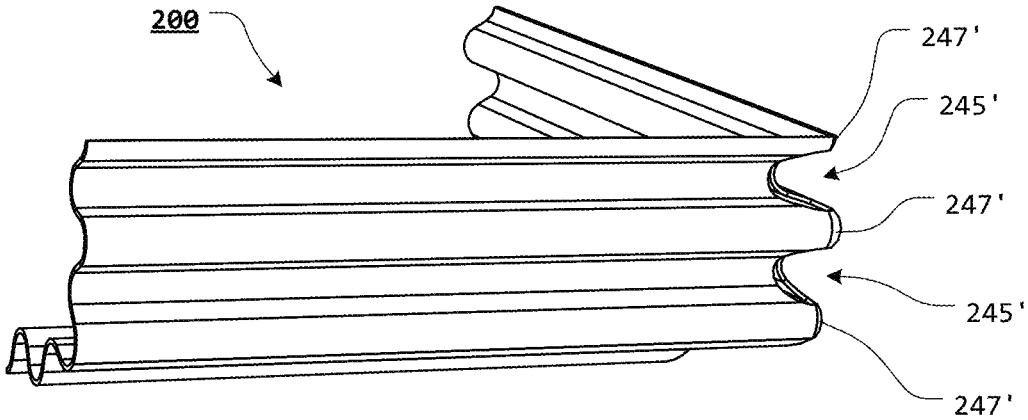
FIG. 31 illustrates an upper, right, rear, perspective view of an exemplary embodiment of a foldable corrugated corner element in a folded position, according to the present disclosure.
Figure 32:
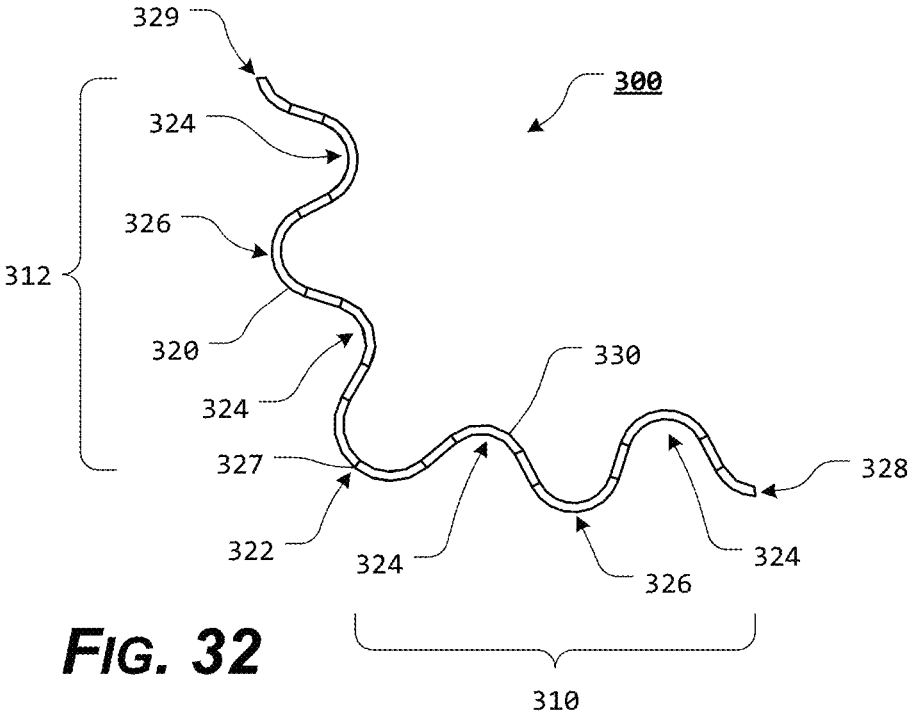
FIG. 32 illustrates a left side view of an exemplary embodiment of a foldable corrugated corner element, according to the present disclosure.
Figure 33:
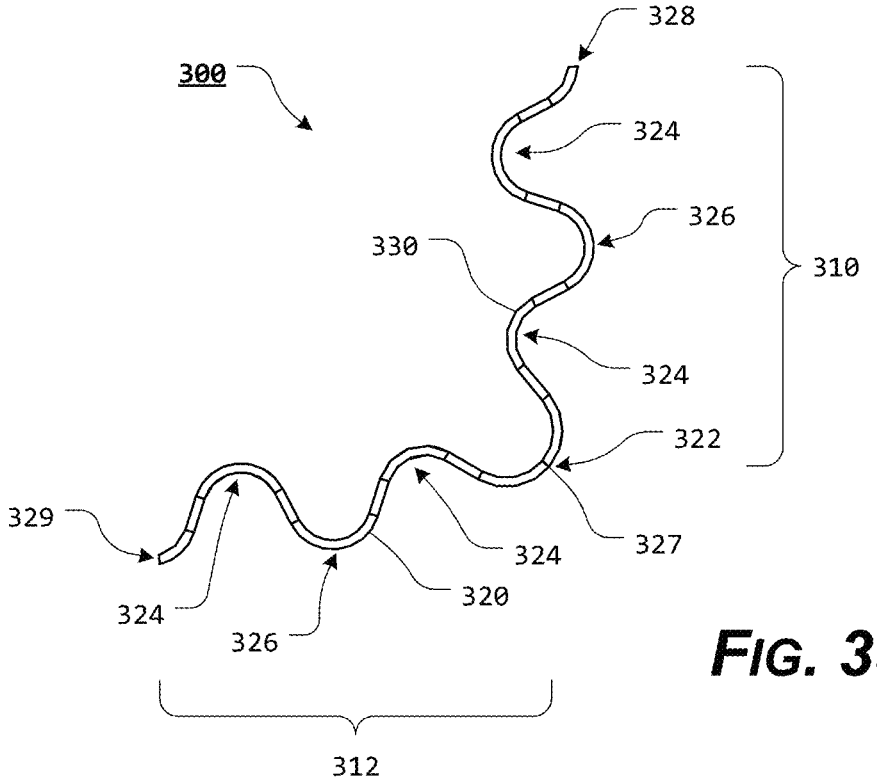
FIG. 33 illustrates a right side view of an exemplary embodiment of a foldable corrugated corner element, according to the present disclosure.
Figure 34:
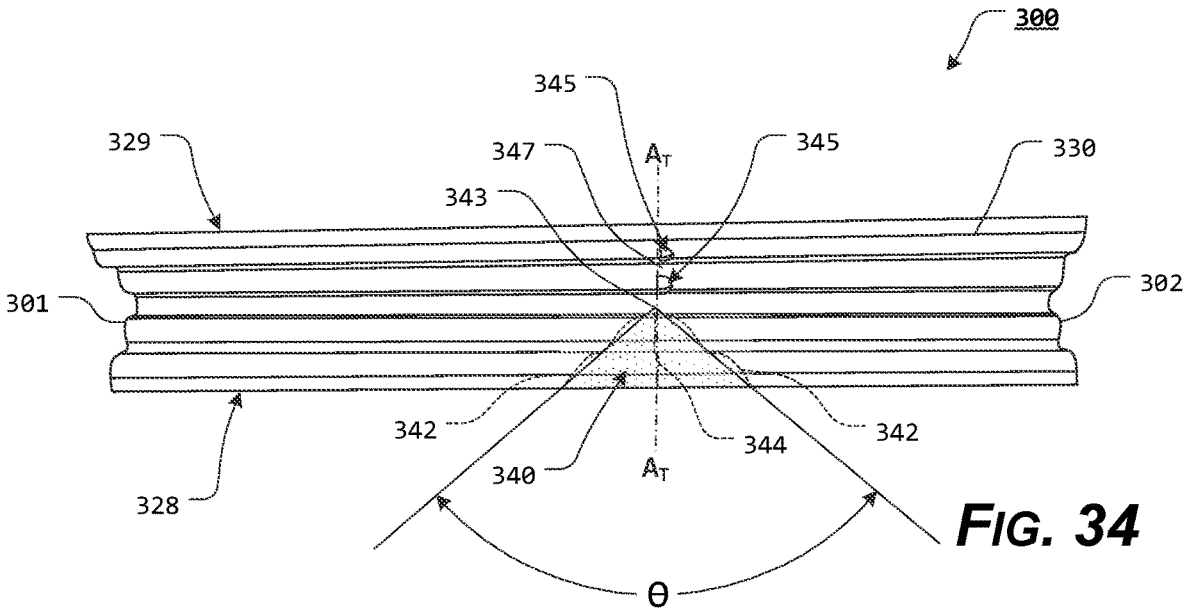
FIG. 34 illustrates an upper, front, perspective view of an exemplary embodiment of a foldable corrugated corner element, according to the present disclosure.
Figure 35:
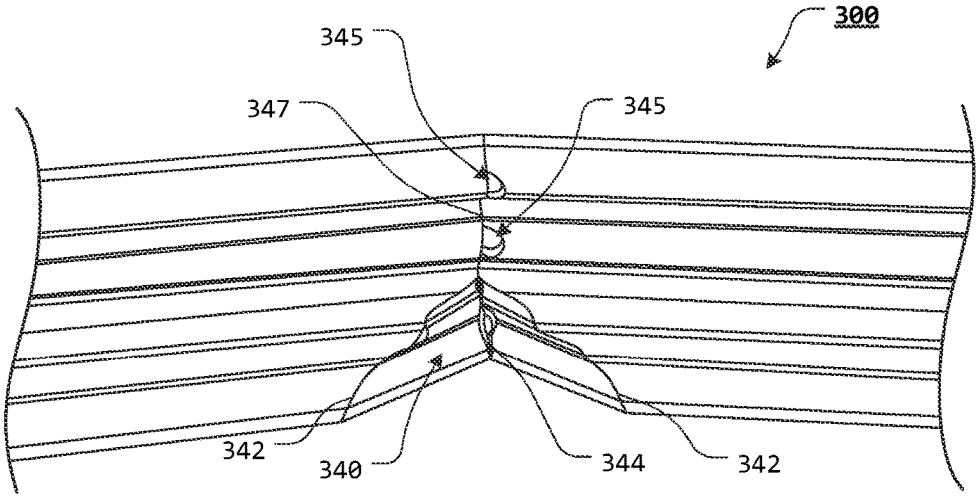
FIG. 35 illustrates an upper, front, perspective view of an exemplary embodiment of a foldable corrugated corner element in a partially folded position, according to the present disclosure.
Figure 36:
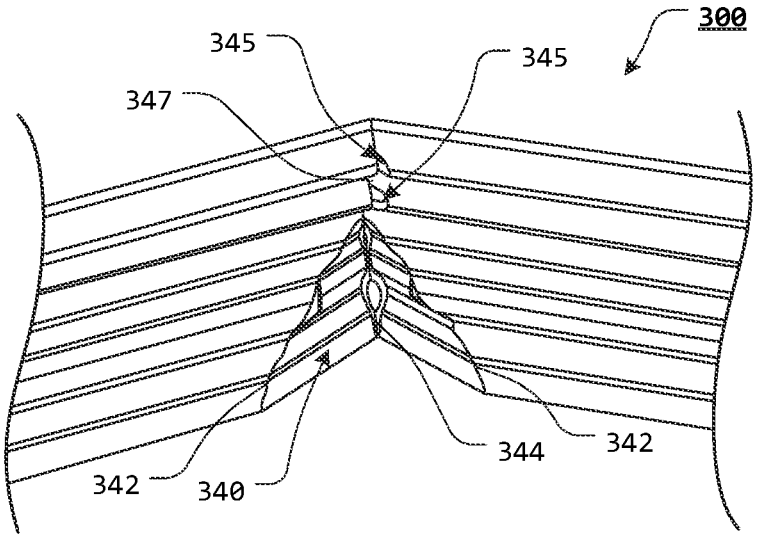
FIG. 36 illustrates an upper, front, perspective view of an exemplary embodiment of a foldable corrugated corner element in a partially folded position, according to the present disclosure.
Figure 37:
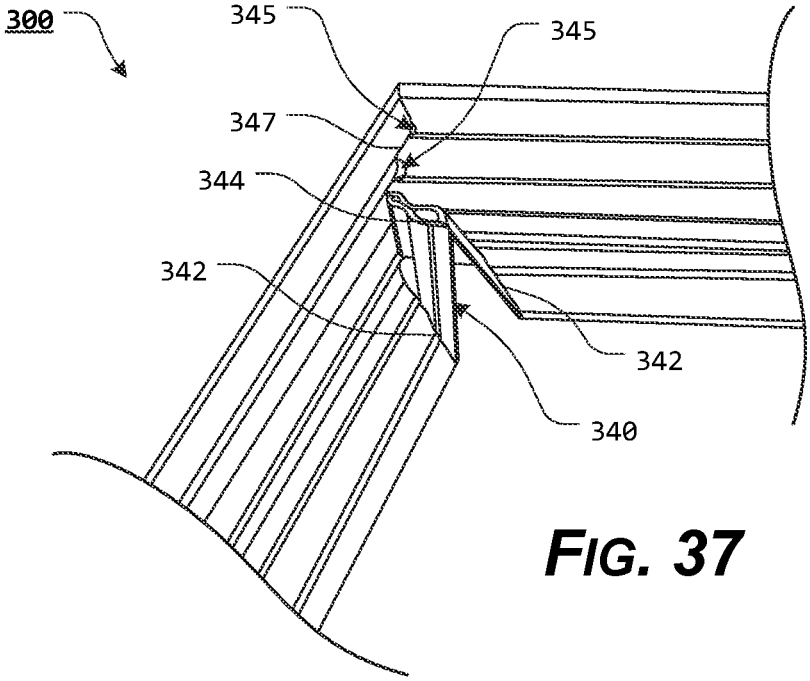
FIG. 37 illustrates an upper, front, left, perspective view of an exemplary embodiment of a foldable corrugated corner element in a partially folded position, according to the present disclosure.

Generally, the apertures 245 are formed so as to extend into portions of the ridges 226 of the outer wall 220, defining hinges 247 in the grooves 224 of the outer wall 220. The apertures 245 extend substantially along the transverse axis, $A_T$. In this manner, when the portions of the second corner element leg 212 are manipulated from an elongate or unfolded position, as illustrated, for example, in FIGS. 8-16, to a partially folded position, as illustrated in FIG. 17, and to a folded position, as illustrated in FIGS. 18-26, the apertures 245 expand and the hinges 247 provide areas of continuity for the second corner element leg 212.

As illustrated in FIGS. 8-26, the apertures 245 are generally formed of a cut or void having substantially parallel sidewalls, substantially parallel to the transverse axis, $A_T$, of the foldable corrugated corner element 200. These apertures 245 may be the result of a saw blade cutting into portions of the ridges 226 of the outer wall 220. The shape of the sidewalls of the apertures 245 are not so limited.

For example, in the exemplary embodiment illustrated in FIGS. 27-31, the apertures 245' are generally formed of an elliptical, oval, or ovular cut or void having substantially non-parallel sidewalls. These apertures 245' may be the result of a punched void formed in portions of the grooves 224 of the outer wall 220 (or ridges 226 of the inner wall 230). The hinges 247' are formed between the apertures 245', typically in the ridges 226 of the outer wall 220. In this manner, as illustrated most clearly in FIG. 31, the alternating apertures 245' and ridges 247' provide an outer corner that allows for substantial continuity of the surfaces of the alternating ridges 226 and/or grooves 224 around the outer corner of the outer wall 220 of the folded foldable corrugated corner element 200.

FIGS. 32-39 illustrate certain elements and/or aspects of exemplary embodiments of a foldable corrugated corner element 300, according to the present disclosure. As illustrated in FIGS. 32-39, the foldable corrugated corner elements 300 comprise an elongate portion of material or a sheet 305, extending substantially parallel to a longitudinal axis, $A_L$, from a first terminal end 301 to a second terminal end 302 and extending substantially parallel to a transverse axis, $A_T$, from a first corner element end 328 to a second corner element end 329, a vertex 322, a first corner element leg 310, a second corner element leg 312, an outer wall 320, an inner wall 330, one or more alternating ridges 326 and/or grooves 324, an optional score mark 327, and one or more alternating apertures 345 and hinges 347 or apertures 345' and hinges 347' (not labeled).

It should be appreciated that these elements correspond to and operate similarly to the sheet 205, extending substantially parallel to a longitudinal axis, $A_L$, from the first terminal end 201 to the second terminal end 202 and extending substantially parallel to a transverse axis, $A_T$, from the first corner element end 228 to the second corner element end 229, the vertex 222, the first corner element leg 210, the second corner element leg 212, the outer wall 220, the inner wall 230, the one or more alternating ridges 226 and/or grooves 224, the optional score mark 227, and the one or more alternating apertures 245 and hinges 247 or apertures 245' and hinges 247', as described herein, with reference to the foldable corrugated corner element 200.

However, as illustrated in FIGS. 32-39, the notch 240 and sidewalls 241 of the foldable corrugated corner element 200 are replaced by score marks 342 defining a substantially V-shaped foldable hinge portion 340.

The substantially V-shaped foldable hinge portion 340 is defined by two or more score marks 342 and optionally a bisecting score mark 344 defining a compound fold area formed in at least a portion of the first corner element leg 310.

The structure or grain of the foldable corrugated corner element 300 or the sheet 305 may make it difficult to create an even bend or fold along a portion of the foldable corrugated corner element 300 or the sheet 305. Providing score marks 342 and optionally bisecting score mark 344 allows the material of the foldable corrugated corner element 300 or the sheet 305 to form or more easily form a bend or fold or more easily form an even or consistent bend or fold.

In certain exemplary, nonlimiting embodiments, the score marks 342 and the optional bisecting score mark 344 are formed of a complete or partial recess or depression in the portion of material or sheet 305 or are formed of complete or partial perforations formed in the portion of material or sheet 305.

In various exemplary embodiments, the score marks 342 and the optional bisecting score mark 344 may be formed of a compressed area of the foldable corrugated corner element 300, without creating a cut. Alternatively, the score marks 342 and the optional bisecting score mark 344 may be formed of a partial cut through the portion of material or sheet 305.

In certain exemplary embodiments, the score marks 342 and the optional bisecting score mark 344 may optionally be formed in a portion of the inner wall 330 or interior surface of the foldable corrugated corner element 300. Alternatively, the score marks 342 and the optional bisecting score mark 344 are formed in a portion of the outer wall 320 or exterior surface of the foldable corrugated corner element 300.

The score marks 342 and the optional bisecting score mark 344 provide a line or portion along which the foldable corrugated corner element 300 may be comparatively more easily bent or folded, whether along the grain or against the grain of the foldable corrugated corner element 300 or the sheet 305. Thus, the score marks 342 and the optional bisecting score mark 344 may optionally provide a compressed or weakened area or portion of the foldable corrugated corner element 300, along which the foldable corrugated corner element 300 may be comparatively more easily bent or folded.

The score marks 342 extend from the first corner element end 328 toward the vertex 322 and converge proximate, at, or beyond the vertex 322, at a converging apex 343. The score marks 342 converge so as to create a foldable hinge portion 340 having an angle θ. In various exemplary embodiments, the angle θ is 90°, so that the score marks 342 extend at 90° relative to one another.

The converging apex 343 of the foldable hinge portion 340 defines where the transverse axis, $A_T$, bisects the longitudinal axis, $A_L$.

The bisecting score mark 344, if included, extends from the first corner element end 128 toward the converging apex 343 of the foldable hinge portion 340. The bisecting score mark 344 may extend from proximate the first corner element end 128 to proximate the converging apex 343.

In various exemplary embodiments, the score marks 342 are provided at an angle θ of 90° and the bisecting score mark 344 is provided such that it extends from the converging apex 343, toward the first corner element end 328, substantially equal distance between the score marks 342.

Figure 38:
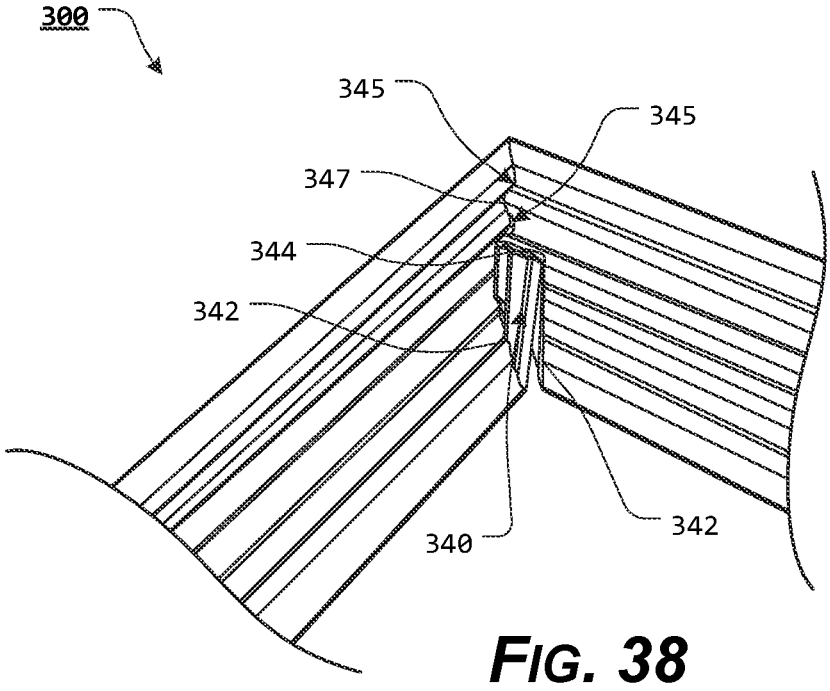
FIG. 38 illustrates an upper, front, left, perspective view of an exemplary embodiment of a foldable corrugated corner element in a folded position, according to the present disclosure.
Figure 39:
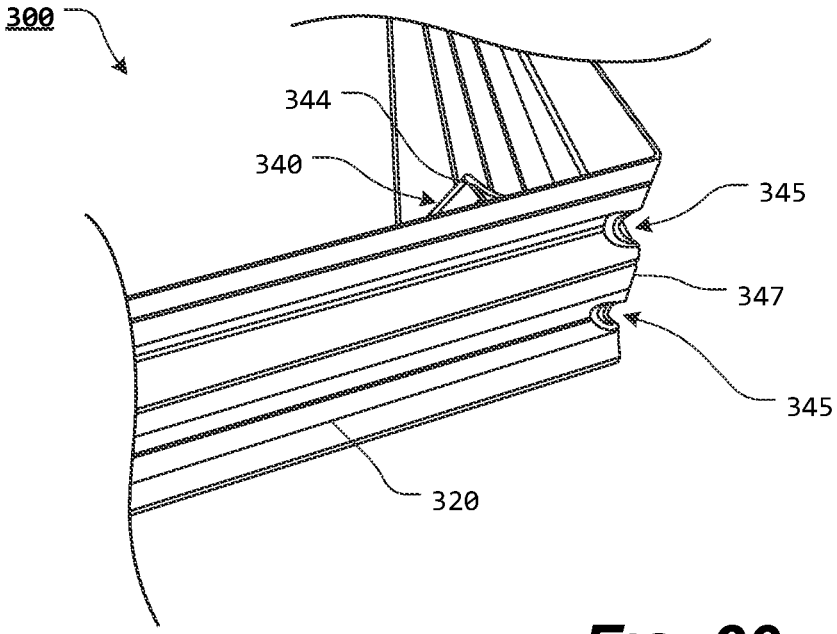
FIG. 39 illustrates an upper, rear, right, perspective view of an exemplary embodiment of a foldable corrugated corner element in a folded position, according to the present disclosure.
Figure 40:
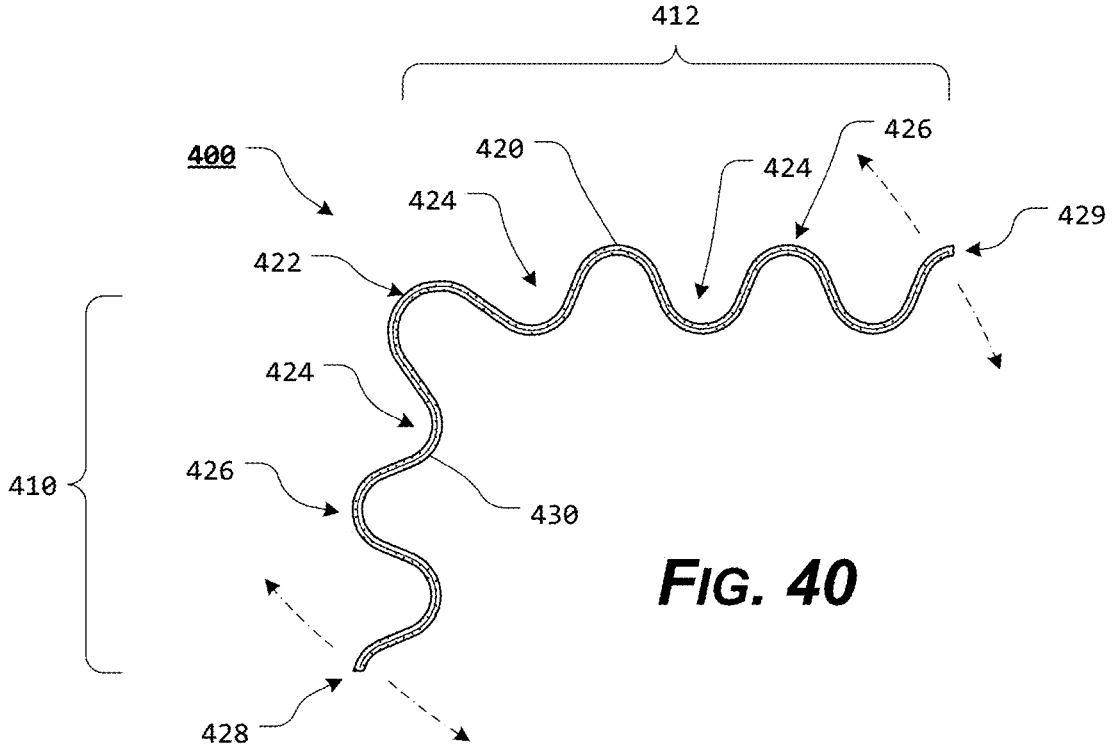
FIG. 40 illustrates a left side view of an exemplary embodiment of a foldable corrugated corner element, according to the present disclosure.
Figure 41:
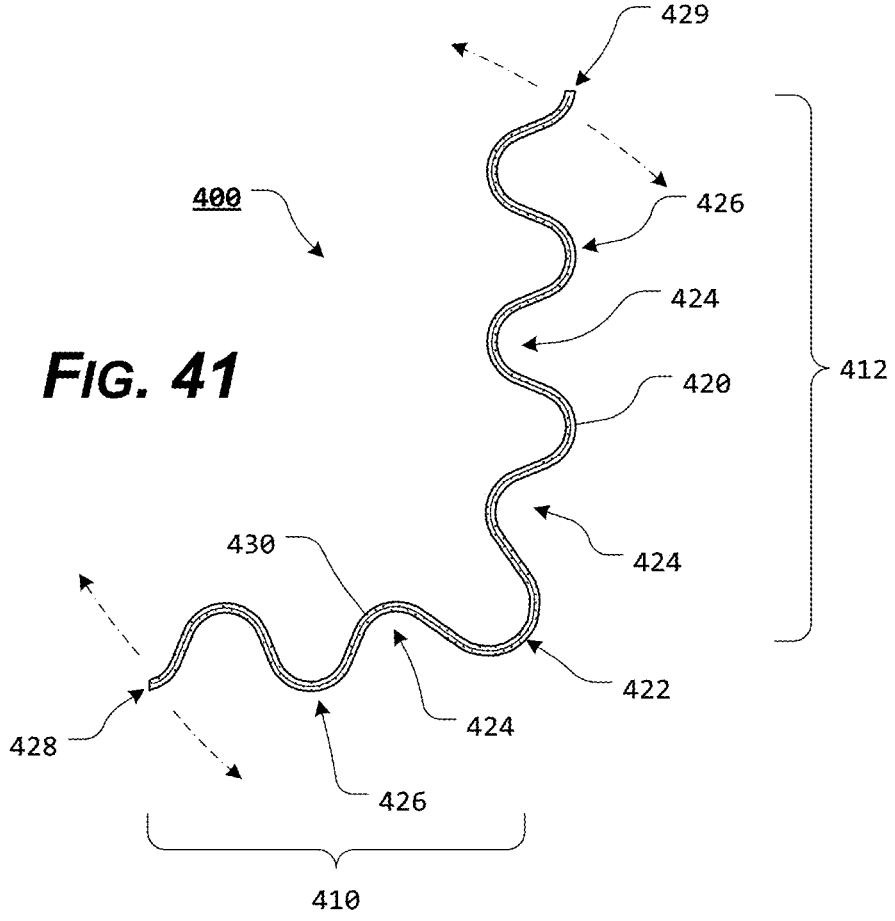
FIG. 41 illustrates a right side view of an exemplary embodiment of a foldable corrugated corner element, according to the present disclosure.

In this manner, by bending or folding the foldable corrugated corner element 300 along the score marks 342 and allowing portions of the foldable hinge portion 340 to be bent or folded along the score marks 342 and the bisecting score mark 344, as illustrated in FIGS. 35-39, a portion of the foldable hinge portion 340 can be urged upward (or downward) to allow the foldable corrugated corner element 300 to be more easily manipulated to the folded position, as illustrated in FIGS. 38-39. In certain embodiments, a portion of the foldable corrugated corner element 300 or the sheet 305 is folded upward, along each of the score marks 342 (away from the inner wall 330). As the portions are folded upward, the portions are simultaneously folded downward, along the bisecting score mark 433.

As the foldable corrugated corner element 300 is folded, along the transverse axis, $A_T$, at least a portion of the outer wall 320, within the folded portions, contacts and adjacent portion of the outer wall 320, within the folded portions, to provide a 90° bend in the second corner element leg 312. It should be appreciated that the angle θ may be greater than 90°, equal to 90°, or less than 90°. Thus, the foldable hinge portion 340 may include score marks 342 formed at any desired angle relative to one another. In this manner, portions of the second corner element leg 312 may be bent, along the transverse axis, $A_T$, at any desired angle. For example, if the angle θ is 45°, the score marks 342 are formed at 45° relative to one another and portions of the second corner element leg 312 may be bent, along the transverse axis, $A_T$, so that the resultant portions of the second corner element leg 312 are at 45° relative to one another when the portions of the outer wall 320, within the folded portions, contact or abut one another.

It should be appreciated that the foldable corrugated corner element 300 may be bent such that neither of the portions of the outer wall 320, within the folded portions, contacts the other the portions of the outer wall 320, within the folded portions.

It should be appreciated that while the substantially V-shaped foldable hinge portion 340 is shown and described as being formed through at least a portion of the first corner element leg 310 and the one or more alternating apertures 345 and hinges 347 are shown and described as being formed through a portion of the second corner element leg 312, the present disclosure is not so limited. Thus, in various exemplary embodiments, the substantially V-shaped foldable hinge portion 340 may optionally be formed through at least a portion of the second corner element leg 312 and the one or more alternating apertures 345 and hinges 347 may optionally be formed through a portion of the first corner element leg 310.

FIGS. 40-43 illustrate certain elements and/or aspects of exemplary embodiments of a foldable corrugated corner element 400, according to the present disclosure. As illustrated in FIGS. 40-43, the foldable corrugated corner elements 400 comprise an elongate portion of material or a sheet 405, extending substantially parallel to a longitudinal axis, $A_L$, from a first terminal end 401 to a second terminal end 402 and extending substantially parallel to a transverse axis, $A_T$, from a first corner element end 428 to a second corner element end 429, a vertex 422, a first corner element leg 410, a second corner element leg 412, an outer wall 420, an inner wall 430, one or more alternating ridges 426 and/or grooves 424, and an optional score mark 427.

As illustrated in FIGS. 40-43, the vertex 422 of the foldable corrugated corner element 400 is not formed along a proximate center of the foldable corrugated corner elements 400 (defining a first corner element leg 410 having a substantially equal length as the second corner element leg 412). Instead, the vertex 422 is formed closer to the first corner element end 428 than the second corner element end 429. Thus, the length of the first corner element leg 410 (as measured between the first corner element end 428 and the vertex 422) is less than the length of the second corner element leg 412 (as measured between the second corner element end 429 and the vertex 422).

Thus, the vertex 422 is formed offset from the center of the foldable corrugated corner element 400 such that the foldable corrugated corner element 400 is generally "L" shaped, while the corrugated corner element 100 is generally "V" shaped, by comparison.

It should also be appreciated that the foldable corrugated corner elements 400 may be formed such that the vertex 422 is formed closer to the second corner element end 429 than the first corner element end 428. Thus, the length of the first corner element leg 410 (as measured between the first corner element end 428 and the vertex 422) may optionally be greater than the length of the second corner element leg 412 (as measured between the second corner element end 429 and the vertex 422).

In these exemplary embodiments, the score mark 427 is formed proximate or along the vertex 422.

The score mark 427 provides a line or portion along which the foldable corrugated corner element 400 may be comparatively more easily bent or folded, whether along the grain or against the grain of the foldable corrugated corner element 400 or the sheet 405. Thus, the score mark 427 may optionally provide a compressed or weakened area or portion of the foldable corrugated corner element 400, along which the foldable corrugated corner element 400 may be comparatively more easily bent or folded.

Figure 42:
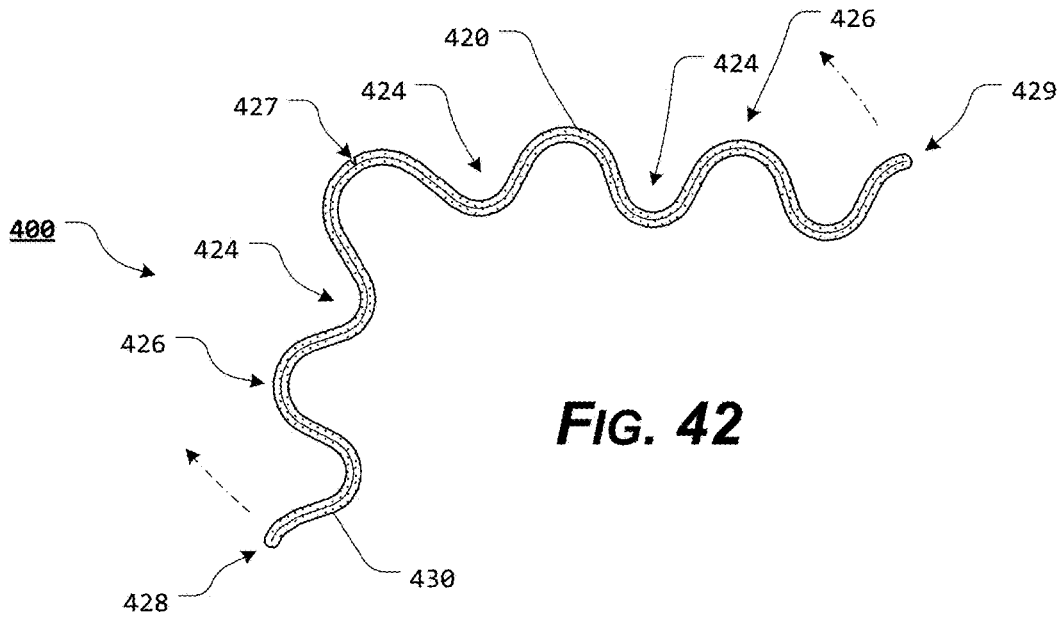
FIG. 42 illustrates a left side view of an exemplary embodiment of a foldable corrugated corner element, according to the present disclosure.
Figure 43:
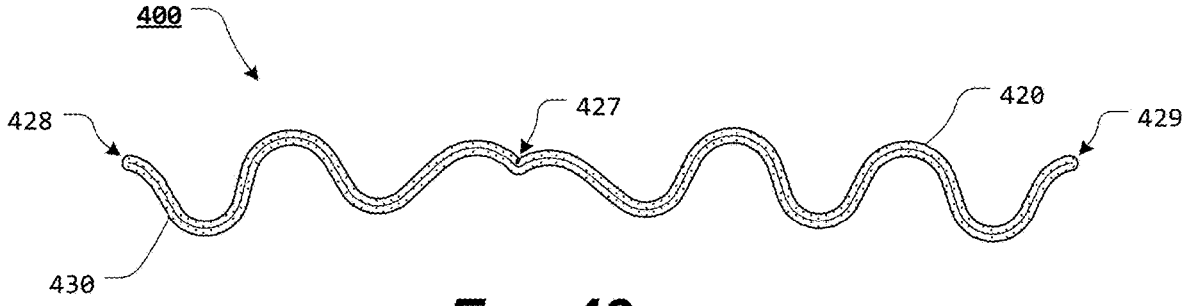
FIG. 43 illustrates a right side view of an exemplary embodiment of a foldable corrugated corner element, according to the present disclosure.

By bending or folding the foldable corrugated corner element 400 along the score mark 427, as illustrated by the semicircular arrows in FIG. 42, a portion of the foldable corrugated corner element 400 can be more easily manipulated to the more flattened position, as illustrated in FIG. 43.

It should be appreciated that the vertex 122, 222, or 322 of the corrugated corner elements 100, the foldable corrugated corner elements 200, or the foldable corrugated corner elements 300, respectively, may be formed such that the respective vertex is formed closer to the first corner element end 128, 228, or 328 than the second corner element end 129, 229, or 329. Thus, the length of the first corner element leg 110, 210, or 310 may be greater than, equal to, or less than the length of the second corner element leg 112, 212, or 312, respectively.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A foldable corrugated corner element, comprising:

a portion of material extending continuously, substantially parallel to a longitudinal axis, from a first terminal end to a second terminal end, wherein said portion of material extends continuously, substantially parallel to a transverse axis, from a first corner element end to a second corner element end;

a vertex extending substantially parallel to said longitudinal axis, between said first corner element end and said second corner element end;

a first corner element leg, extending laterally from said vertex, said first corner element leg having one or more alternating ridges and grooves, each of said alternating ridges and grooves of said first corner element leg extending substantially parallel to said longitudinal axis of said foldable corrugated corner element;

a second corner element leg, extending laterally from said vertex and away from said first corner element leg, said second corner element leg having one or more alternating ridges and grooves, each of said alternating ridges and grooves of said second corner element leg extending substantially parallel to said longitudinal axis of said foldable corrugated corner element;

a notch formed in at least a portion of said first corner element leg extending from said first corner element end toward said vertex, wherein said notch is defined by sidewalls, wherein said sidewalls converge at a converging apex, wherein said notch allows said second corner element leg to be folded, along said transverse axis, such that at least a portion of one of said sidewalls contacts or abuts at least a portion of said other sidewall;

one or more apertures formed through a portion of said second corner element leg, substantially along said transverse axis; and a hinge defined between adjacent apertures, wherein if said second corner element leg is folded, said apertures expand and each hinge provides an area of continuity for a portion of said second corner element leg.

2. The foldable corrugated corner element of claim 1, wherein said portion of material comprises a single layer of material.

3. The foldable corrugated corner element of claim 1, wherein said portion of material comprises a multi-layer portion of material.

4. The foldable corrugated corner element of claim 1, wherein said vertex is defined closer to said first corner element end than said second corner element end.

5. The foldable corrugated corner element of claim 1, wherein said vertex is defined closer to said second corner element end than said first corner element end.

6. The foldable corrugated corner element of claim 1, wherein each of said alternating ridges and grooves of said first corner element leg are alternating ridges and grooves, extending substantially parallel to said vertex and wherein each of said alternating ridges and grooves of said second corner element leg are alternating ridges and grooves, extending substantially parallel to said vertex.

7. The foldable corrugated corner element of claim 1, wherein said first corner element leg and said second corner element leg are each curvilinear along a respective length.

8. The foldable corrugated corner element of claim 1, wherein an inner wall of said first corner element leg and an inner wall of said second corner element leg comprises a sinusoidal succession of waves or curves.

9. The foldable corrugated corner element of claim 1, wherein said notch is a substantially V-shaped notch.

10. The foldable corrugated corner element of claim 1, wherein said notch is an indentation extending into at least a portion of said first corner element leg.

11. The foldable corrugated corner element of claim 1, wherein said transverse axis bisects said longitudinal axis at said converging apex.

12. The foldable corrugated corner element of claim 1, wherein said sidewalls expand away from said converging apex at 90° relative to one another, at less than 90° relative to one another, or at greater than 90° relative to one another.

13. The foldable corrugated corner element of claim 1, wherein said apertures are substantially elliptical, oval, or ovular.

14. The foldable corrugated corner element of claim 1, wherein said apertures are defined by substantially parallel aperture sidewalls.

15. The foldable corrugated corner element of claim 1, wherein said apertures are formed in portions of said ridges of an outer wall of said second corner element leg and said hinges are formed in portions of said grooves of said outer wall of said second corner element leg.

16. The foldable corrugated corner element of claim 1, wherein said apertures are formed in portions of said grooves of an outer wall of said second corner element leg and said hinges are formed in portions of said ridges of said outer wall of said second corner element leg.

17. The foldable corrugated corner element of claim 1, wherein a score mark formed in said portion of material, extending substantially parallel to said longitudinal axis, wherein said score mark provides a line or portion along which said foldable corrugated corner element may be bent or folded such that said foldable corrugated corner element may be more easily manipulated to a more flattened position.

18. A foldable corrugated corner element, comprising:

a portion of material extending substantially parallel to a longitudinal axis, from a first terminal end to a second terminal end, wherein said portion of material extends extending substantially parallel to a transverse axis, from a first corner element end to a second corner element end;

a first corner element leg having one or more alternating ridges and grooves, each of said alternating ridges and grooves of said first corner element leg extending substantially parallel to said longitudinal axis of said foldable corrugated corner element;

a second corner element leg, extending from said first corner element leg, said second corner element leg having one or more alternating ridges and grooves, each of said alternating ridges and grooves of said second corner element leg extending substantially parallel to said longitudinal axis of said foldable corrugated corner element;

a notch formed in at least a portion of said first corner element leg extending from said first corner element end toward a said vertex, wherein said notch is defined by sidewalls, wherein said sidewalls converge at a converging apex, wherein said notch allows said second corner element leg to be folded, along said transverse axis, until at least a portion of one of said sidewalls contacts or abuts at least a portion of said other sidewall;

one or more apertures formed through a portion of said second corner element leg, substantially along said transverse axis; and a hinge defined between adjacent apertures, wherein if said second corner element leg is folded, said apertures expand and each hinge provides an area of continuity for a portion of said second corner element leg.

19. The foldable corrugated corner element of claim 18, wherein a score mark provides a line or portion along which said foldable corrugated corner element may be more easily manipulated to a more flattened position.

* * * * *